US006796294B2

(12) United States Patent
Tsubouchi

(10) Patent No.: US 6,796,294 B2
(45) Date of Patent: Sep. 28, 2004

(54) INTERNAL COMBUSTION ENGINE

(75) Inventor: Masanori Tsubouchi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/702,390

(22) Filed: Nov. 5, 2003

(65) Prior Publication Data

US 2004/0139939 A1 Jul. 22, 2004

(30) Foreign Application Priority Data

Jan. 17, 2003 (JP) ..... 2003-010416
Jan. 17, 2003 (JP) ..... 2003-010418

(51) Int. Cl.[7] ..... F01L 13/08; F01L 1/18; F01L 1/047; F02F 1/38; F02M 37/04

(52) U.S. Cl. ..... 123/508; 123/182.1; 123/90.6

(58) Field of Search ..... 123/508, 182.1, 123/90.27, 90.31, 90.38, 90.6, 196 W

(56) References Cited

U.S. PATENT DOCUMENTS 5,816,208 A * 10/1998 Kimura ..... 123/182.1
5,829,414 A * 11/1998 Tsunoda et al. ..... 123/508
5,899,181 A * 5/1999 Kurata et al. ..... 123/90.17
6,082,336 A * 7/2000 Takahashi et al. ..... 123/508
6,374,792 B1 * 4/2002 Suzuki et al. ..... 123/182.1
6,386,168 B2 * 5/2002 Suzuki et al. ..... 123/182.1
6,513,504 B2 * 2/2003 Ikuma ..... 123/509
6,532,927 B2 * 3/2003 Suzuki et al. ..... 123/182.1

FOREIGN PATENT DOCUMENTS

JP 03-003904 1/1991
JP 2000-227064 8/2000

* cited by examiner

*Primary Examiner*—Weilun Lo
(74) *Attorney, Agent, or Firm*—Carrier, Blackman & Associates, P.C.; Joseph P. Carrier; William D. Blackman

(57) ABSTRACT

An internal combustion engine has a valve train and decompression mechanisms disposed in a valve chamber, and a fuel pump attached to a cylinder head. A pump cam for driving the actuating rod of a fuel pump through a swing arm, and a decompression mechanism opposite an end journal relative to the pump cam with respect to an axial direction parallel to the axis of the camshaft are formed on the camshaft in the valve chamber. One of the decompression mechanisms is disposed between the pump cam and an exhaust cam. The swing arm has a contact tip in contact with the pump, cam and a pushing tip in contact with the actuating rod at a position nearer to the exhaust cam than the contact part with respect to the axial direction. The pump cam comes into contact with an end bearing supporting the camshaft to restrain the camshaft from axial movement. The above structure serves to suppress increase in the length of the camshaft in the axial dimension of the valve chamber, and the projection in the axial direction of the fuel pump from the cylinder head 4, whereby the internal combustion engine can be formed in compact construction.

8 Claims, 10 Drawing Sheets

INTERNAL COMBUSTION ENGINE

BACKGROUND OF THE INVENTION

1. Field of the Invention

The present invention relates to an internal combustion engine provided with a decompression mechanism incorporated into a camshaft included in a valve train and disposed in a valve chamber. The internal combustion is intended for use as, for example, an outboard engine.

2. Description of the Related Art

An internal combustion engine intended for use as an outboard engine disclosed in, for example, JP2000-227064A (FIGS. 4 and 5) is a two-cylinder internal combustion engine provided with a decompression mechanism. This two-cylinder internal combustion engine is provided with a camshaft disposed in a cam chamber defined by a cylinder head and a cylinder head cover, cams formed on the camshaft to operate intake valves and exhaust valves, rocker arms driven for a rocking motion by the cams, a decompression lever mounted on the camshaft so as to be turnable in a vertical plane under the cams for operating the exhaust valves, and a fuel pump. The internal combustion engine disclosed in JP2000-227064A is provided with flanges at the upper and the lower ends of the camshaft to restrain the camshaft from axial movement.

A three-cylinder internal engine, intended for use as an outboard engine, disclosed in JP3-3904A is provided with a camshaft supported in a plurality of bearings on a cylinder head, cams formed on the cam shaft to rock rocker arms (hereinafter referred to as "valve cams"), and a fuel pump that is driven by a pump driving mechanism including an eccentric cam formed on the camshaft at a position between the lowermost valve cam and the lowermost bearing, and a rod operated by the eccentric cam. The fuel pump is attached to a side surface of the cylinder head. The rod has a first end in contact with the eccentric cam and a second end in contact with a contact part of an actuating member included in the fuel pump. The first and the second ends of the rod are at substantially the same positions with respect to a direction parallel to the axis of the camshaft, and the eccentric cam and the contact part coincide with each other with respect to the direction parallel to the axis of the camshaft. The eccentric cam is fitted in a groove formed in a thrust holder formed integrally with a bearing cap holding the lowermost bearing with the opposite side surface thereof in contact with the opposite side surfaces of the groove of the thrust holder. Thus, the eccentric cam is restrained from axial movement by the groove of the thrust holder. When the fuel pump is driven by the eccentric cam formed on the camshaft (hereinafter, referred to as pump cam), the first and the second ends of the rod, i.e., a cam follower for transmitting the driving force of the pump cam to the fuel pump, are at the same positions with respect to the direction parallel to the axis of the camshaft as mentioned in JP3-3904A. When it is desired to incorporate the eccentric cam, the rod and the fuel pump mentioned in JP3-3904A into the prior art internal combustion engine disclosed in JP2000-227064A, the fuel pump protrudes down greatly from the cylinder head, the length of the camshaft needs to be increased to avoid interference between the rod, and members and parts in the valve chamber, such as bosses through which head bolts are extended to fasten the cylinder head to the cylinder block. Consequently, the length of the cam chamber must be increased.

When the valve cam for the intake valve, the valve cam for the exhaust valve and the decompression lever for each cylinder, and the pair of flanges, and the pump cam for driving the fuel pump are formed on the camshaft according to the technique disclosed in JP2000-227064A, the camshaft inevitably become long to form the pump cam and the flanges in different parts of the camshaft and, consequently, the cam chamber containing the camshaft inevitably becomes long.

The internal combustion engine disclosed in JP3-3904A is not provided with any decompression mechanism, the thrust holder is disposed between the lowermost bearing and the second lowermost bearing and between the valve cams for the lowermost cylinder and the eccentric cam. Therefore, the length of the camshaft must be increased to incorporate a decompression mechanism into the lowermost cylinder.

The present invention has been made in view of the foregoing circumstances and it is therefore an object of the present invention to suppress the increase of the length of a camshaft disposed in a valve chamber and provided with a pump cam and a decompression mechanism, the axial protrusion of the fuel pump from a valve chamber forming member, and the increase of the axial dimension of a valve chamber, and to provide a compact internal combustion engine.

SUMMARY OF THE INVENTION

According to the present invention, an internal combustion engine comprises: a camshaft interlocked with a crankshaft; a valve chamber forming member forming a valve chamber for containing the camshaft; a valve train arranged in the valve chamber to open and close intake and exhaust valves; decompression mechanisms arranged in the valve chamber to open the intake or the exhaust valves during a compression stroke; a fuel pump having an actuating member extending in the valve chamber, and attached to the valve chamber forming member; a plurality of bearings arranged in the valve chamber to support the camshaft; journals formed in the camshaft and supported by the bearings, the number of the journals being equal to that of the bearings; wherein a pump cam for driving the actuating member through a cam follower is formed adjacently to the end journal at one axial end of the camshaft among the journals on the camshaft, a specific one of the decompression mechanisms and the end journal are disposed on the opposite sides, respectively, of the pump cam with respect to an axial direction, the camshaft is provided with a valve cam for opening and closing the intake or the exhaust valve to be opened by the specific decompression mechanism, the specific decompression mechanism is disposed between the pump cam and the valve cam, the cam follower has a contact part in contact with the pump cam and an acting part in contact with the actuating member at a position nearer to the valve cam than the contact part with respect to the axial direction.

Since the acting part of the cam follower that transmits the driving force of the pump cam to the actuating member of the fuel pump is farther from the end journal than the contact part, the actuating member, hence the fuel pump, can be disposed apart from the end journal, hence from an end wall of the valve chamber forming member, with respect to the axial direction. Moreover interference between the actuating member and members at the same position as the pump cam with respect to the axial direction can be avoided.

Consequently, the present invention has the following effects. Since the specific decompression mechanism is adjacent to the end journal at the axial end among the plurality of journals and is disposed between the pump cam for driving the actuating member through the cam follower, and the valve cam for opening and closing the intake or the exhaust valve opened by the decompression mechanism, and the cam follower has the contact part in contact with the pump cam and the acting part in contact with the actuating member at a position nearer to the valve cam than the contact part with respect to the axial direction, the actuating member, hence the fuel pump, can be spaced from the end wall of the valve chamber forming member with respect to the axial direction. Since interference between the actuating member and members at the same position as the pump cam with respect to the axial direction can be avoided, the increase of the length of the camshaft and the axial protrusion of the fuel pump from the valve chamber forming member can be suppressed, and thereby the internal combustion engine is compact.

In the internal combustion engine according to the present invention, the pump cam may be adjacent to a specific one of the plurality of bearings, and the specific decompression mechanism may be disposed opposite the specific bearing relative to the pump cam and adjacently to the pump cam to form a thrust bearing member for restraining the camshaft from axial movement.

Since the pump cam serves as a thrust-bearing member, the camshaft is shorter than a camshaft provided with a pump cam and a separate thrust-bearing member, and the decompression mechanism can be disposed adjacently and close to the pump cam.

Such construction provides the following effects. The pump cam for driving the fuel pump serves as the thrust bearing member adjacent to the specific bearing among the bearings supporting the plurality of journals of the camshaft and capable of restraining the axial movement of the camshaft, an axial space is available because the decompression mechanism is disposed opposite the specific bearing and adjacently to the pump cam, the increase of the length the camshaft provided with the pump cam and the decompression mechanisms can be suppressed because the decompression mechanism can be disposed near the pump cam, and thereby the enlargement of the valve chamber can be suppressed and the internal combustion engine can be formed in a short axial length.

In the internal combustion engine according to the present invention, the pump cam may be disposed so as to be in contact with the specific one of the plurality of bearings to make the pump cam serve as the thrust bearing member for restraining the camshaft from axial movement, the pump cam and the valve cams associated with a cylinder included in the internal combustion engine, and the specific decompression mechanism may be disposed between the specific bearing and the bearing axially adjacent to the specific bearing, and the valve cams or the specific decompression mechanism may be disposed axially opposite the specific bearing with respect to the pump cam so as to be adjacent to the pump cam.

Since the pump cam thus serves also as a thrust-bearing member, an axial space along the camshaft is formed between the specific bearing and the bearing adjacent to the specific bearing disposed on the opposite sides, respectively of the cylinder. Since the valve cams or the decompression mechanism is disposed axially adjacently to the pump cam between the specific bearing and the bearing adjacent to the specific bearing, the valve cams or the decompression mechanism can be disposed axially close to the pump cam.

Such construction provides the following effects. The pump cam for driving the fuel pump serves as the thrust bearing member disposed adjacently to the specific one of the bearings supporting the plurality of journals of the camshaft to restrain the camshaft from axial movement, the axial space is formed along the camshaft between the specific bearing and the bearing adjacent to the specific bearing disposed on the opposite sides, respectively, of the cylinder by disposing the pump cam and the valve cams associated with the cylinder, and the decompression mechanism between the specific bearing and the bearing adjacent to the specific bearing and disposing the valve cams or the decompression mechanism opposite the specific bearing and adjacently to the pump cam, and the valve cams and the decompression mechanism can be disposed near the pump cam. Thus, the increase of the length the camshaft provided with the pump cam and the decompression mechanisms can be suppressed, and thereby the enlargement of the valve chamber can be suppressed and the internal combustion engine can compactly be formed.

In this specification, unless otherwise specified, "axial directions" signifies a direction parallel to the axis of the camshaft.

DESCRIPTION OF THE PREFERRED EMBODIMENTS

Preferred embodiments of the present invention will be described with reference to FIGS. 1 to 10.

Figure 1:
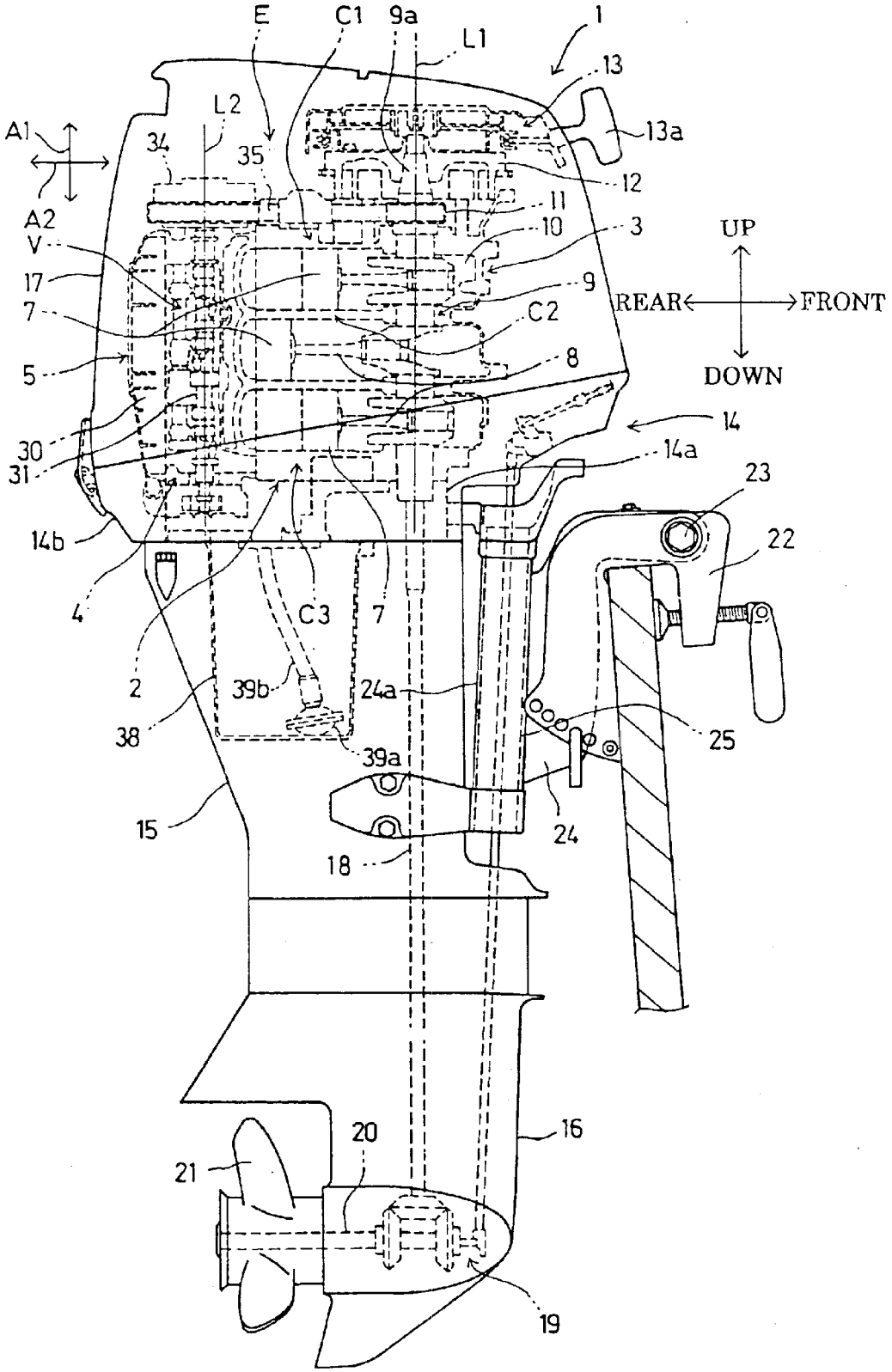
FIG. 1 is a schematic, right-hand side elevation of an outboard engine including an internal combustion engine in a preferred embodiment of the present invention.

Referring to FIG. 1 showing the right side of an outboard engine 1 employing an internal combustion engine E in a preferred embodiment of the present invention in a schematic side elevation, the internal combustion engine E is a vertical internal combustion engine having a crankshaft extending with its axis L1 in a vertical position. More specifically, the internal combustion engine E is a three-cylinder in line overhead-camshaft water-cooled four-stroke cycle vertical internal combustion engine.

Figure 2:
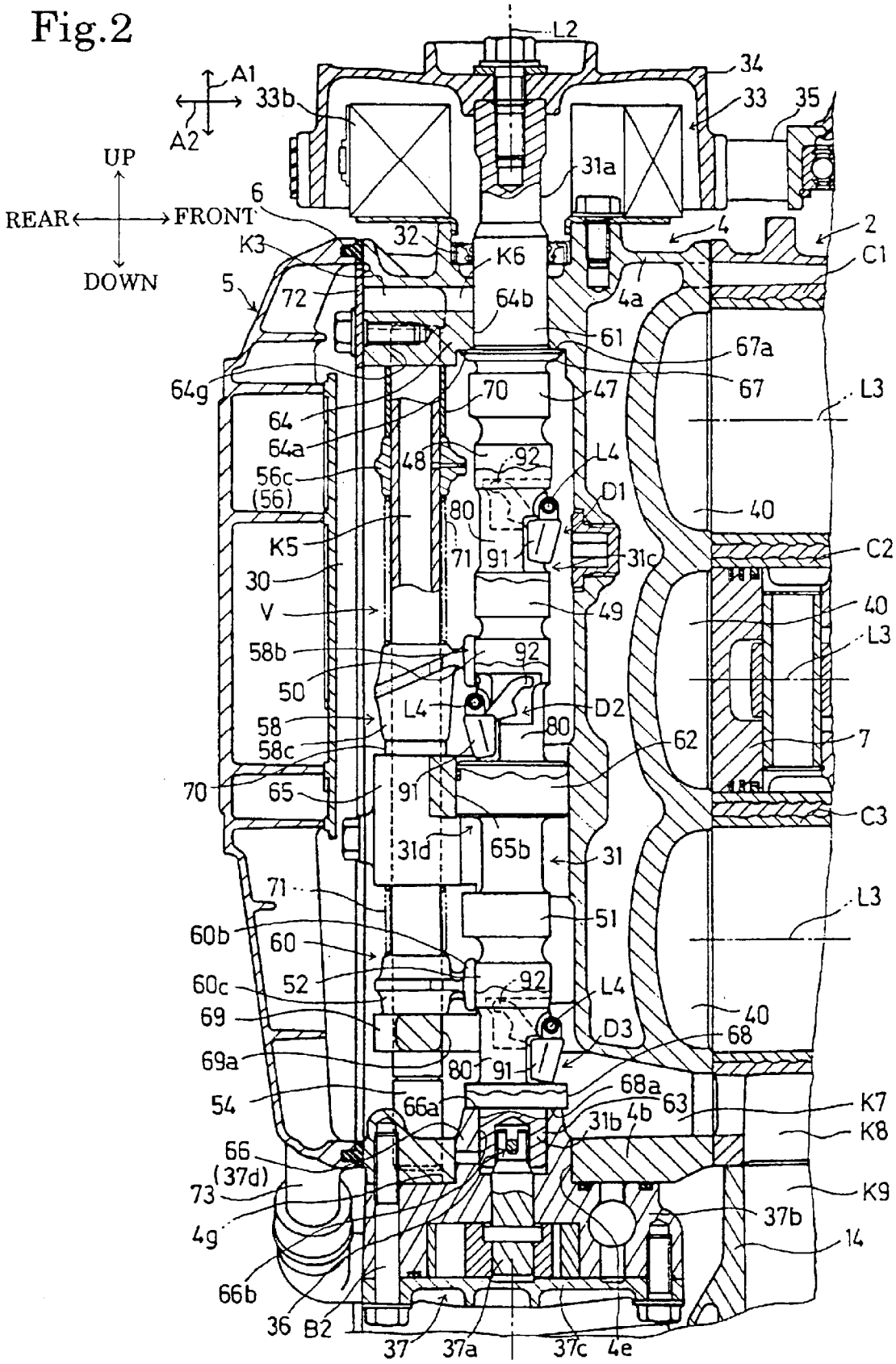
FIG. 2 is a sectional view taken on the line II—II in FIG. 3.
Figure 3:
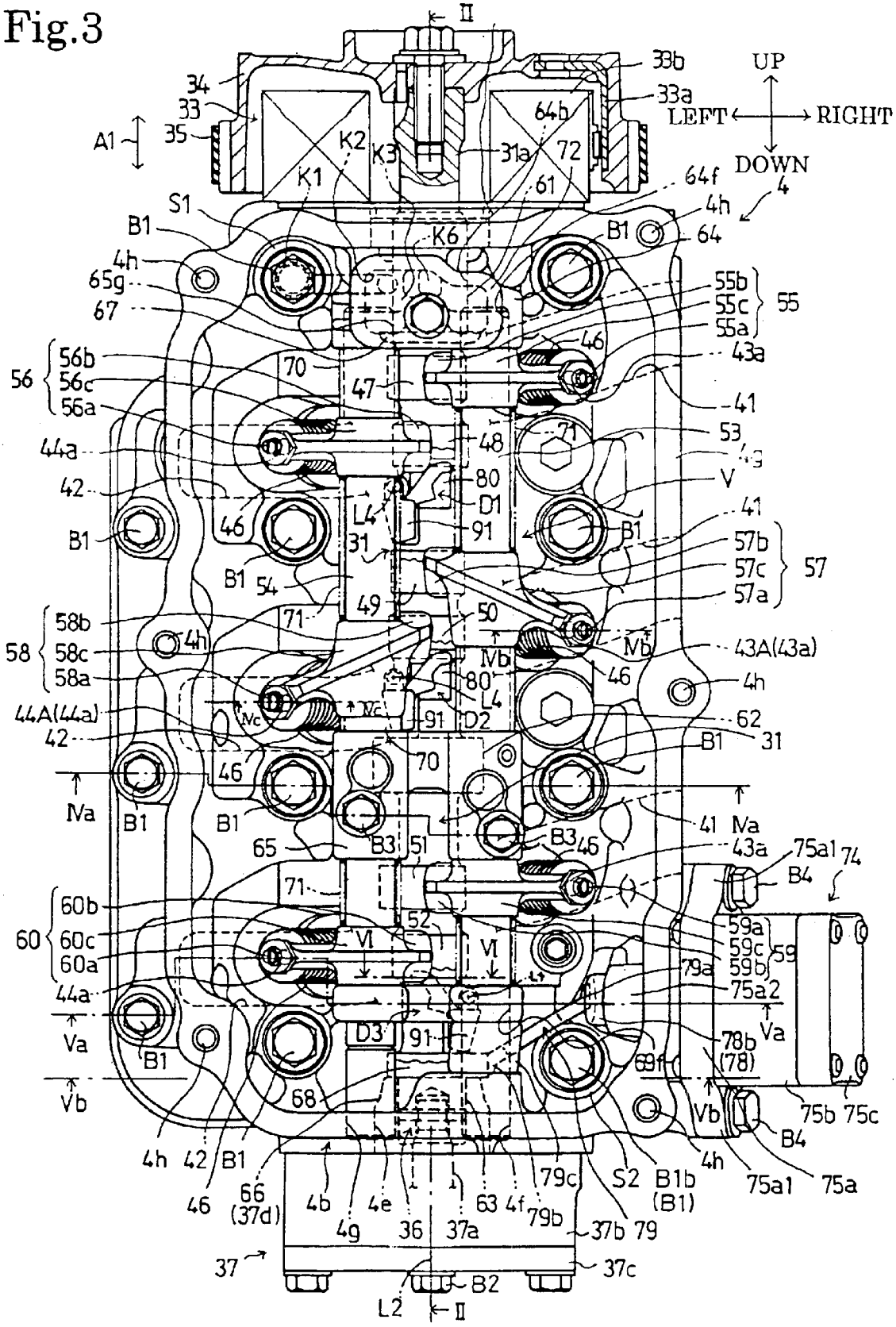
FIG. 3 is a rear view of a cylinder head included in the internal combustion engine shown in FIG. 1 with a head cover removed.

The internal combustion engine B has a cylinder block 2 provided with a first cylinder C1, a second cylinder C2 and a third cylinder C3, a crankcase 3 fasted to the front end of the cylinder block 2 with a plurality of bolts, a cylinder head 4 fastened to the rear end of the cylinder block 2 with a plurality of bolts B1 (FIGS. 3 and 4), and a head cover 5 fastened to the sealing surface 4*g* (FIG. 3) of the rear end of the cylinder head 4 with an annular sealing member 6 (FIG. 2) held between the rear end of the cylinder head 4 and the head cover 5 in close contact with the sealing surface 4*g* by screwing a plurality of bolts in threaded holes 4*h* (FIG. 3).

In this embodiment, words including up, upward, down, downward, front, forward, rear, rearward, right, rightward, left, leftward and such are used to express positions, sides, directions and such in connection with the front end, the rear end, the right side, the left side and such of a ship on which the outboard engine 1 is mounted. Thus, an upward direction is one of opposite axial directions A1 parallel to the axis L2 of a camshaft 31, a downward direction is the other of the opposite axial directions A1, a forward direction is one of the opposite directions A2 parallel to the axes L3 (FIG. 2) of the cylinders C1 to C3, and a rearward direction is the other of the opposite directions A2. A side, on which intake valves 43 are arranged, on one side of a reference plane including the axes L3 of the cylinders and parallel to the camshaft 31 or the axis L1 of the crankshaft 9 is called an intake side, and a side, on which exhaust valves 44 are arranged, on the other side of the reference plane is called an exhaust side.

Pistons 7 fitted for reciprocation in the cylinders C1 to C3 are connected to the crankshaft 9 by connecting rods 8. The crankshaft 9 is disposed in a crank chamber 10 defined by a front part of the cylinder block 2 and the crankcase 3 and is supported for rotation by main bearings on the cylinder block 2 and the crankcase 3. A crankshaft pulley 11, a flywheel 12 serving also as a flywheel magnet, and a recoil starter 13 provided with a starter knob 13*a* and serving as a starting device are mounted and arranged on an upper end part 9*a* of the crankshaft 9 projecting upward from the crank chamber 10 in that order upward.

A lower engine case 14 has a mount case 14*a* and an under case 14*b*, which are formed integrally. The cylinder block 2 is joined to the mount case 14*a*. The upper end of an extension case 15 is joined to the lower end of the lower engine case 14. A gear case 16 is joined to the lower end of the extension case 15. The under case 14*b* of the lower engine case 14 covers a lower part of the internal combustion engine E and the mount case 14*a*. An upper engine cover 17 is joined to the upper end of the lower engine case 14 with a sealing member held between the upper engine cover 17 and the upper end of the lower engine case 14. The upper engine cover 17 covers an upper part of the internal combustion engine E. Thus, the internal combustion engine E is contained in an engine compartment formed by the under case 14*b* and the upper engine cover 17. The mount case 14*a* and the under case 14*b* may be separately formed and may be joined together to form the lower engine case 14.

A drive shaft 18 is connected to the lower end of the crankshaft 9 and extends through the lower engine case 14. The drive shaft 18 is interlocked with a propeller shaft 20 by a forward/reverse change gear 19 consisting of a bevel gear mechanism and a clutch mechanism and contained in the gear case 16. The power of the internal combustion engine E is transmitted from the crankshaft 9, through the drive shaft 18, the forward/reverse change gear 19 and the propeller shaft 20 to a propeller 21 to drive the propeller 21 for rotation.

A swivel case 24 is supported for turning in a vertical plane by a tilt shaft 23 on a transom clamp 22 for detachably mounting the outboard engine 1 on the ship. A swivel shaft 25 is fitted in a tubular support part 24*a* of the swivel case 24 so as to be turnable. The swivel shaft 25 has an upper end connected to the lower engine case 14 by a rubber mount, and a lower end connected to the extension case 15 by a rubber mount. A steering handle, not shown, connected to the swivel shaft 25 is turned in a horizontal plane to turn the outboard engine 1 on the swivel shaft 25 in a horizontal plane for steering.

Referring to FIGS. 1 and 2, a valve chamber 30 is formed by the cylinder head 4 and the cylinder head cover 5. Arranged in the valve chamber 30 are a valve train V for opening and closing intake valves 43 and exhaust valves 44 (FIG. 4), and decompression mechanisms D1 to D3 for relieving compression pressures in the cylinders C1 to C3 during compression strokes at the start of the internal combustion engine E. The valve train V includes a camshaft 31. The cylinder head 4 and the head cover 5 are valve chamber forming members for forming the valve chamber 30.

Figure 4:
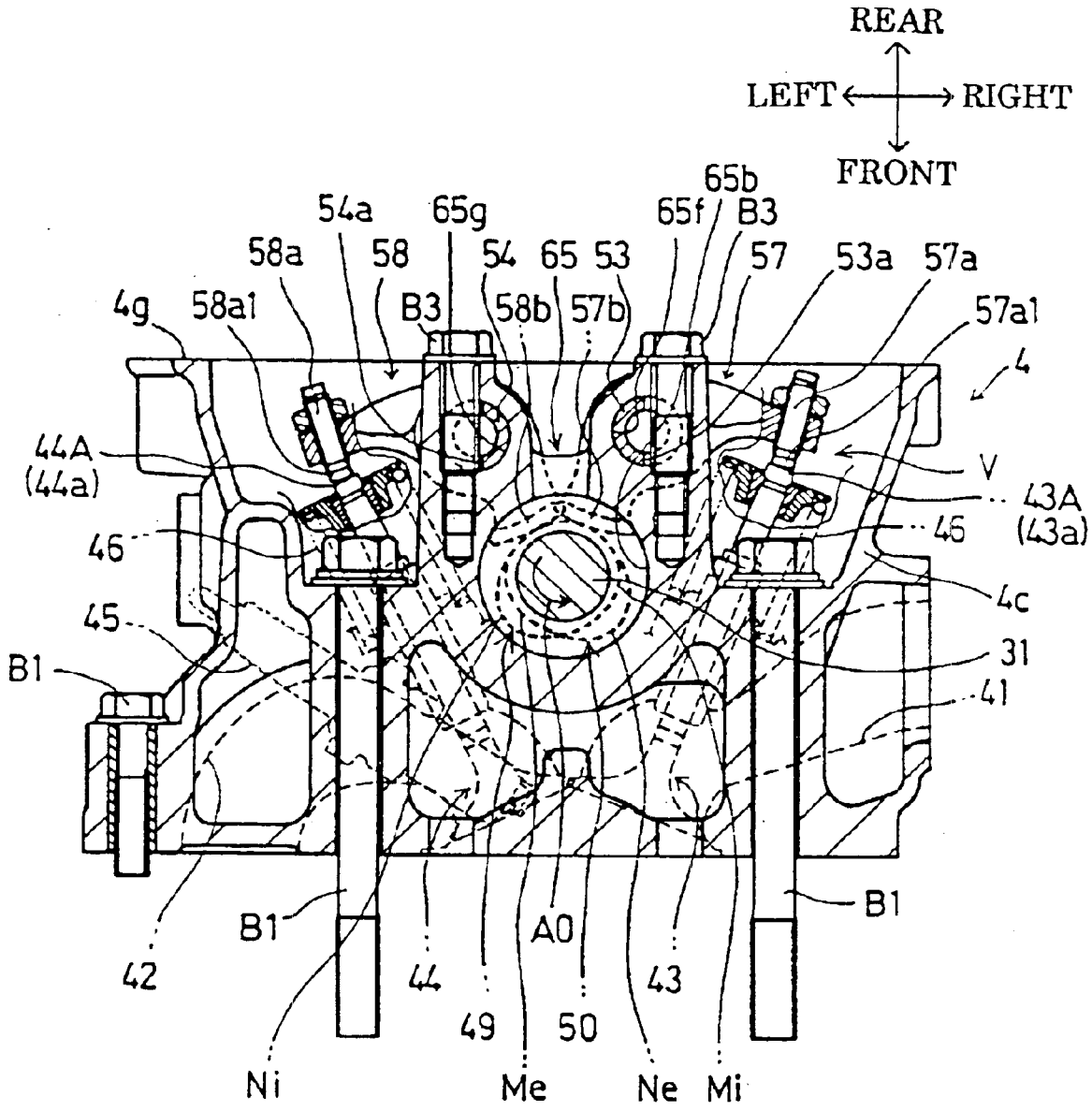
FIG. 4 is a sectional view generally taken on the line IVa—IVa in FIG. 3, including a sectional view of a part around the free end of an exhaust rocker arm near an exhaust valve taken on the line IVb—IVb in FIG. 3, and a sectional view of a part around the free end of an exhaust rocker arm near an exhaust valve taken on the IVc—IVc in FIG. 3.
Figure 6:
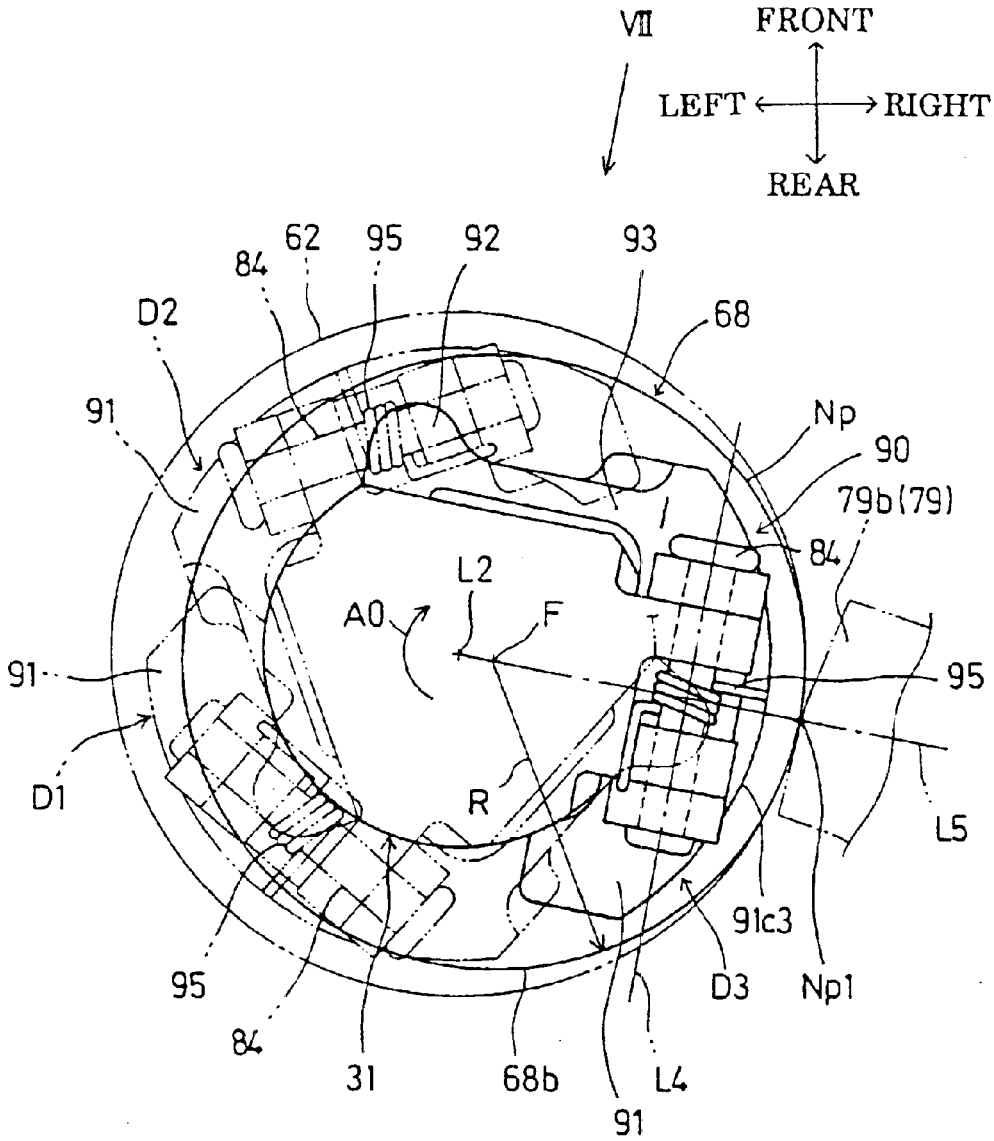
FIG. 6 is a sectional view taken on the line VI—VI in FIG. 3, of assistance in explaining the arrangement of a decompression mechanism with respect to the rotating direction of the camshaft.

The camshaft 31 is supported for rotation on the cylinder head 4 in the valve chamber 30 with its axis L2 extended parallel to the axis L1 (FIG. 1) of the crankshaft 9. As shown in FIG. 2, the camshaft 31 penetrates the upper wall 4*a* of the cylinder head 4, i.e., an end wall at one end of the cylinder head 4 with respect to the axial direction A1. An oil seal 32 seals the gap between the camshaft 31 and the upper wall 4*a*. A pulse generator 33 for detecting the angular position of the camshaft 31, and a camshaft pulley 34 are mounted and arranged on an upper end part 31*a* of the camshaft 31 projecting upward from the valve chamber 30 in that order upward. The power of the crankshaft 9 is transmitted to the camshaft 31 by a power transmitting mechanism including the crankshaft pulley 11, the camshaft pulley 34 and a timing belt 35 extended between the crankshaft pulley 11 and the camshaft pulley 34 to drive the camshaft 31 at half the rotating speed of the crankshaft 9 in a direction A0 (FIGS. 4 and 6).

The pulse generator 33 includes one magnetic member 33 a(FIG. 3) attached to the inner surface of the camshaft pulley 34, and a coil unit 33*b* attached to the upper wall 4*a* and surrounding the upper end part 31*a*. The coil unit 33*b* includes three pickup coils arranged at equal circumferential intervals. The magnetic member 33*a* passes the three pickup coils successively as the camshaft 31 rotates. Ignition for the cylinders C1 to C3 is timed on the basis of the output signals of the pickup coils.

A trochoid oil pump 37 has a pump body 37*b* and a pump cover 37*c*. The oil pump 37 is fastened to the lower wall 4*b*, i.e., the other end wall with respect to the axial direction A1, of the cylinder head 4 with a plurality bolts B2 passed through the pump body 37*b* and the pump cover 37*c*. The oil pump 37 has a shaft 37*a* connected to the lower end of the camshaft 31 by a connecting member 36. The camshaft 31 drives the shaft 37*a*. The oil pump 37 sucks lubricating oil contained in an oil pan 38 (FIG. 1) attached to the lower end of the lower engine case 14 through a suction pipe 39*b* provided with an oil strainer 39*a*, and suction passages formed in the cylinder block 2 and the cylinder head 4. The lubricating oil discharged from the oil pump 37 flows through discharge passages formed in the cylinder head 4 and the cylinder block 2, and an oil filter into a main oil gallery. The lubricating oil is distributed from the main oil gallery to the main bearings and to moving parts to be lubricated.

The internal combustion engine E will be described with reference FIGS. 2 and 3.

The first cylinder C1, the second cylinder C2 and the third cylinder C3 are arranged in a row along the axial direction A1. The second cylinder C2 is the middle cylinder. The first cylinder C1 and the third cylinder C3 are on the opposite sides, respectively, of the second cylinder C2.

Referring to FIG. 4, the cylinder head 4 is provided with a combustion chamber 40, an intake port 41 through which intake gas supplied from an intake device, not shown, attached to the right wall 4*c* of the cylinder head 4, i.e., a side wall on the intake side, is supplied into the combustion chamber 40, and an exhaust port through which the combustion gas is discharged from the combustion chamber 40 into an exhaust passage, not shown, for each of the cylinders C1 to C3. The intake device includes carburetors, i.e., fuel supply devices for producing air-fuel mixture by introducing fuel into intake air, respectively for the cylinders C1 to C3, and an intake manifold for distributing the air-fuel mixture to the intake ports 41.

An intake valve 43 for opening and closing the intake port and an exhaust valve 44 for opening and closing the exhaust port are slidably inserted in valve guides on the cylinder head 4 for each of the cylinders C1 to C3. Valve springs 46 force by their resilience the intake valve 43 and the exhaust valve 44 for each of the cylinders C1 to C3 back up onto their valve seats.

In the suction stroke, in which the intake valve 43 is opened and the piston 7 moves toward the bottom dead center, the air-fuel mixture is sucked through the intake port 41 into the combustion chamber 40. In the compression stroke, the air-fuel mixture is compressed by the piston 7 moving toward the top dead center, ignited by an ignition plug 45 attached to a part of the cylinder head 4 on the exhaust side above the exhaust valve 44 and burns. In the expansion stroke, the piston 7 is moved toward the bottom dead center by the pressure of a combustion gas, driving the crankshaft 9 through the connecting rod 8 for rotation. In the exhaust stroke, in which the piston moves toward the top dead center, the combustion gas is discharged as an exhaust gas from the combustion chamber 40 through the exhaust port 42 into the exhaust passage. The exhaust gas is discharged through an exhaust pipe from the outboard engine 1.

The valve train V includes the camshaft 31 extended in the valve chamber across the cylinders C1 to C3 and provided with intake cams 47, 49 and 51, and exhaust cams 48, 50 and 52 for the cylinders C1 to C3, a pair of rocker-arm shafts supported on the cylinder head 4 nearer to the head cover 5 than the camshaft 31, i.e., an intake rocker-arm shaft 53 and an exhaust rocker-arm shaft 54, intake rocker arms 55, 57 and 59, and exhaust rocker arms 56, 58 and 60 supported for rocking motion on the intake rocker-arm shaft 53 and the exhaust rocker-arm shaft 54, respectively (FIG. 3). The intake rocker arms 55, 57 and 59, and the exhaust rocker arms 56, 58 and 60 are cam followers driven by the intake cams 47, 49 and 51, and the exhaust cams 48, 50 and 52, respectively. Those component parts of the valve train V are arranged in the valve chamber 30.

The camshaft 31 has journals 61, 62 and 63 supported by bearings 64, 65 and 66, respectively, in the valve chamber 30. The journals 61 to 63 of the camshaft 31 are a first end journal 61 formed on the camshaft 31 at a position in the upper end part of the valve chamber 30 near the upper end part 31*a*, a second end journal 63 formed on the lower end part 31*b* of the camshaft 31 coinciding with the connecting member 36 with respect to the axial direction A1 in the lower end part of the valve chamber 30, and a middle journal 62 formed in a middle part of the camshaft 31 between the first end journal 61 and the second end journal 63. The diameter of the middle journal 62 is greater than those of the end journals 61 and 63. The bearings 64 to 66 are a first end bearing 64 formed integrally with the upper wall 4*a* to support the first end journal 61, a second end bearing 66 formed in the lower wall 4*b* to support the second end journal 63, and a middle bearing 65 positioned between the end bearings 64 and 66 to support the middle journal 62.

The first end bearing 64 and the middle bearing 65 are formed integrally with the cylinder head 4 and protrude toward the head cover 5. The second end bearing 66 coinciding with the connecting member 36 with respect to the axial direction Al is a tubular projection 37*d* formed integrally with the pump body 37*b* and projecting through a through hole 4*e* formed in the lower wall 4*b* into the valve chamber 30. The bearings 64 to 66 are provided with bearing holes 64*b*, 65*b* and 66*b* for slidably receiving the journals 61 to 63, respectively.

The camshaft 31 is integrally provided with a flange 67 having a contact surface 67*a* in contact with an end surface 64*a*, facing the valve chamber, of the first end bearing 64, and a plate-shaped pump cam 68, i.e., an eccentric cam, having a contact surface 68*a* in contact with an end surface 66*a*, facing the valve chamber, of the second end bearing 66. The pump cam 68 is adjacent to the second end bearing 66, i.e., a specific bearing. The flange 67 and the pump cam 68 are in contact with the end bearings 64 and 66, respectively to serve as thrust bearing members for restraining the camshaft 31 from movement in the axial directions A1. More concretely, the flange 67 in contact with the end surface 64*a* restrains the camshaft 31 from upward movement, and the pump cam 68 in contact with the end surface 66*a* restrains the camshaft 31 from downward movement.

The camshaft 31 is integrally provided with the intake cam 47 and the exhaust cam 48 for the first cylinder C1, i.e., the upper end cylinder, the intake cam 51 and the exhaust cam 52 for the third cylinder C3, i.e., the lower end cylinder, and intake cam 49 and the exhaust cam 50 for the second cylinder C2 in parts thereof between the flange 67 and the pump cam 68.

As best shown in FIG. 4, the intake cams 47, 49 and 51, and the exhaust cams 48, 50 and 52 have round base parts Mi and Me for closing the corresponding intake valves 43 and exhaust valves 44 pushed in the closing direction by the valve springs 46, respectively, and cam lobes Ni and Ne for timing the opening and closing operations and lifts of the corresponding intake valves 43 and exhaust valves 44, respectively.

In the cylinders C1 to C3, the exhaust cams 48, 50 and 52 are below the intake cams 47, 49 and 51, respectively. Decompression mechanisms D1 to D3 are disposed below the exhaust cams 48, 50 and 52, respectively. The decompression mechanisms D1 to D3 opens and closes the exhaust valves 44 during the compression stroke in starting the internal combustion engine E by means of the recoil starter 13. The decompression mechanisms D1 to D3 open the exhaust valves 44 by a small decompression lift to enable the air-fuel mixture compressed in the cylinders C1 to C3 to escape through the slightly opened exhaust ports 42 to relieve compression pressure for a decompressing operation.

The intake cams 47 and 49, the exhaust cams 48 and 50, and the decompression mechanisms D1 and D2 respectively associated with the first cylinder C1 and the second cylinder C2 are arranged between the middle journal 62 and the first end journal 61. The intake cam 51, the exhaust cam 52 and the decompression mechanism D3 associated with the third cylinder C3 are arranged between the middle journal 62 and the second end journal 63. Views of parts, around the decompression mechanisms D1 to D3, of the camshaft shown in FIGS. 1 to 3 are those taken from an angular direction different from an angular direction from which the rest of the parts of the camshaft 31 are viewed. Actually, the decompression mechanisms D1 to D3 are arranged at equal angular intervals with respect to the rotating direction A0 of the camshaft 31.

A cylindrical part 31*c* of the camshaft 31 extends between the intake cam 49 for the second cylinder C2 nearer to the first cylinder C1 than the exhaust cam 50 and the decompression mechanism D2, and the decompression mechanism D1 associated with the first cylinder C1, is nearer to the second cylinder C2 than the intake cam 47 and the exhaust cam 48 for the first cylinder, and is not supported by any bearing and not provided with any journal.

The intake cam 49 among the intake cam 49, the exhaust cam 50 and the decompression mechanism D2 associated with the second cylinder C2 is adjacent to the decompression mechanism D1 among the intake cam 47, the exhaust cam 4B and the decompression mechanism D1 associated with the first cylinder C1. Therefore, a part, adjacent to the decompression mechanism D1 associated with the first cylinder C1 with respect to the axial direction A1, of the camshaft 31 is the intake cam 49 for the second cylinder C2. Thus, a centrifugal weight 91 included in the decompression mechanism D1 and the intake cam 49 are adjacent to each other.

The middle journal 62 is formed in a cylindrical part 31*d*, extending between the decompression mechanism. D2 nearer to the third cylinder C3 than the intake cam 49 and the exhaust cam 50 for the second cylinder, and the intake cam 51 nearer to the second cylinder C2 than the exhaust cam 52 and the decompression mechanism D3 associated with the third cylinder C3, of the camshaft 31. The middle journal 62 is supported by the middle bearing 65.

The intake cam 51, the exhaust cam 52 and the decompression mechanism D3 associated with the third cylinder C3 are arranged between the second end bearing 66 and the middle bearing 65 adjacent to the second bearing 66 with respect to the axial direction A1. The decompression mechanism D3 among the intake cam 51, the exhaust cam 52 and the decompression mechanism D3 is disposed near the pump cam 68 with respect to the axial direction A1 opposite the second bearing 66 with respect to the pump cam 68.

The intake cam 49 for the second cylinder C2 is at a short distance toward the intake cam 47 for the first cylinder C1 from a position dividing the interval with respect to the axial direction A1 between the intake cams 47 and 51 respectively for the first cylinder C1 and the third cylinder C3 into two equal parts. Similarly, the exhaust cam 50 for the second cylinder C2 is at a short distance toward the exhaust cam 48 for the first cylinder C1 from a position dividing the interval with respect to the axial direction A1 between the exhaust cams 48 and 52 respectively for the first cylinder C1 and the third cylinder C3 into two equal parts. The decompression mechanism D2 for the second cylinder C2 is disposed in a space extending in the axial direction A1 and formed by disposing the intake cam 49 and the exhaust cam 50 of the second cylinder C2 nearer to the first cylinder C1.

The camshaft 31 is mounted on the cylinder head 4 in the following manner. The camshaft 31 provided with the decompression mechanisms D1 to D3 is passed upward through the through hole 4*e* of a diameter greater than that of the middle Journal 62, a through hole 69*a* of a diameter greater than that of the middle journal 62 formed in a shaft support 69, the bearing hole 65*b* of the middle bearing 65, and the bearing hole 64*b* of the first end bearing 64. Then, the oil pump 37 is joined to the lower wall 4*b* such that the contact surface 67*a* of the flange 67 is in contact with the first bearing 64 and the second end journal 63 is fitted in the bearing hole 66*b* of the second end bearing 66.

Referring to FIGS. 2 to 5, the rocker-arm shafts 53 and 54 are inserted in through holes 4*f* and 4*g* formed in the lower wall 4*b*. The rocker-arm shafts 53 and 54 are passed through a pair of through holes 69*f* (FIG. 3) and 69*g* (FIG. 5) formed in a rocker support 69 formed integrally with the cylinder head 4 at a position between the lower wall 4*b* and the middle bearing 65 so as to protrude toward the head cover 5. The rockerarm shafts 53 and 54 are extended upward through the through holes 4*f* and 4*g* formed in the lower wall 4*b*, a pair of through holes 65*f* and 65*g* formed in the middle bearing 65 and a pair of through holes 64*f* and 64*g* formed in the first end bearing 64, respectively. As shown in FIG. 4, bolts B3 are screwed through cuts 53*a* and 54*a* formed in parts, in the middle bearing 65, of the rocker-arm shafts 53 and 54 in threaded holes formed in the middle bearing 65 to restrain the rocker-arm shaft 53 and 54 from rotation and to hold the same in place.

Referring to FIGS. 2 to 4, the intake rocker arms 55, 57 and 59 have ends provided with adjusting screws 55*a*, 57*a* and 59*a*, respectively. The tips of the adjusting screws 55*a*, 57*a* and 59*a* (only the tip 57*a*1 of the adjusting screw 57 is shown in FIG. 4) are in contact with the ends 43*a* of the valve stems of the intake valves 43 (the end 43*a* of the valve stem in contact with the tip 57*a*1 of the adjusting screw 57*a* attached to the intake rocker arm 57 is denoted by 43A for convenience' sake). The intake rocker arms 55, 57 and 59 have the other ends provided with slippers 55*b*, 57*b* and 59*b*, i.e., contact parts, in contact with the intake cams 47, 49 and 51, respectively. Fulcrums 55*c*, 57*c* and 59*c* provided with through holes are formed in middle parts, between the adjusting screws 55*a*, 57*a* and 59*a*, and the slippers 55*b*, 57*b* and 59*b*, of the intake rocker arms 55, 57 and 59, respectively. The intake rocker-arm shaft 53 is extended through the through holes of the fulcrums 55*c*, 57*c* and 59*c*.

The exhaust rocker arms 56, 58 and 60 have ends provided with adjusting screws 56*a*, 58*a* and 60*a*, respectively. The tips of the adjusting screws 56*a*, 58*a* and 60*a* (only the tip 58*a*1 of the adjusting screw 58 is shown in FIG. 4) are in contact with the ends 44*a* of the valve stems of the exhaust valves 44 (the end 44*a* of the valve stem in contact with the tip 58*a*1 of the adjusting screw 58*a* attached to the exhaust rocker arm 58 is denoted by 44A for convenience' sake). The exhaust rocker arms 56, 58 and 60 have the other ends provided with slippers 56*b*, 58*b* and 60*b*, i.e., contact parts, in contact with the exhaust cams 48, 50 and 52, respectively. Fulcrums 56*c*, 58*c* and 60*c* provided with through holes are formed in middle parts, between the adjusting screws 56*a*, 58*a* and 60*a*, and the slippers 56*b*, 58*b* and 60*b*, of the exhaust rocker arms 56, 58 and 60, respectively. The exhaust rocker-arm shaft 54 is extended through the through holes of the fulcrums 56*c*, 58*c* and 60*c*.

Positioning collars 70 and positioning springs 71 are mounted on the intake rocker-arm shaft 53 and the exhaust rocker-arm shaft 54 to position the intake rocker arms 55, 57 and 59, and the exhaust rocker arms 56, 58 and 60 respectively for the cylinders C1 to C3 with respect to the axial direction A1.

The intake rocker arm 57 and the exhaust rocker arm 58 for the second cylinder C2 are specific rocker arms. The tips of the adjusting screws 57*a* and 58*a* of the intake rocker arm 57 and the exhaust rocker arm 58 are offset toward the decompression mechanism D2, i.e., downward, with respect to the axial direction A1 relative to the corresponding slippers 57*b* and 58*b*. The tip of the adjusting screw 58*a* of the exhaust rocker arm 58 coincides with the decompression mechanism D2 with respect to the axial direction A1. The tip 57*a*1 of the adjusting screw 57*a* of the intake rocker arm 57, the end of 43A of the valve stem of the intake valve 43, and the exhaust cam 50 coincide with each other with respect to the axial direction A1. Consequently, a straight line connecting the slipper 57*b* and the tip of the adjusting screw 57*a* of the intake rocker arm 57, and a straight line connecting the slipper 58*b* and the tip of the adjusting screw 58*a* of the exhaust rocker arm 58 extend obliquely relative to the intake rocker-arm shaft 53 and the exhaust rocker-arm shaft 54, respectively.

The exhaust cam 50 is a specific valve cam for operating the exhaust rocker arm 58 to operate the exhaust cam 44, operated by the decompression mechanism D2, for the second cylinder C2. The exhaust cam 50 does not coincide with and is positioned above the end 44A of the valve stem of the exhaust valve 44 for the second cylinder C2 with respect to the axial direction A1. The decompression mechanism D2 coincides with the end 44A of the valve stem of the exhaust valve 44 with respect to the axial direction A1. The second cylinder C2 is a specific cylinder.

The intake cams 47, 49 and 51 and the exhaust cams 48, 50 and 52 rotating together with the camshaft 31 rocks the intake rocker arms 55, 57 and 59 and the exhaust rocker arms 56, 58 and 60 to open and close the intake valves 43 and the exhaust valves 44 for the cylinders C1 to C3 at predetermined crank angles, respectively.

Referring to FIGS. 2 and 3, part of the lubricating oil sent into the main oil gallery flows through an annular oil passage K1 formed between a bolt hole formed in a top boss S1 formed in a part of the cylinder head 4 on the exhaust side and a head bolt B1 inserted in the bolt hole of the top boss S1, and an oil passage K2 formed in the cylinder head 4 into a small oil chamber K3 sealed by a cover 72. Then, the lubricating oil flows from the oil chamber K3 through oil passages K4 and KS (FIG. 5) formed in the hollow rocker-arm shafts 53 and 54, and radial oil holes formed in the rocker-arm shafts 53 and 54 to the sliding parts of the intake rocker arms 55, 57 and 59, the exhaust rocker arms 56, 58 and 60, the intake rocker-arm shaft 53 and the exhaust rocker-arm shaft 54, flows through an oil passage K6 formed in the first end bearing 64 and opening into the bearing hole 64*b* to the sliding parts of the first end bearing 64 and the first end journal 61, flows through the oil passage K4, and holes formed in the intake rocker-arm shaft 53 and the middle bearing 65 to the sliding parts of the middle, bearing 65 and the middle journal 62. A through hole 4*g* into which the lower ends of the oil passages K4 and KS open is covered with the pump body 37*b* of the oil pump 37.

The lubricating oil flowed through the small holes and lubricated the sliding parts drips into the valve chamber 30, and lubricates the sliding parts of the intake cams 47, 49 and 51, the exhaust cams 48, 50 and 52, the intake rocker arms 55, 57 and 59, the exhaust rocker arms 56, 58 and 60, the sliding parts of the decompression mechanisms D1 to d3, and the sliding parts of the second end bearing 66 and the second end journal 63, and then collects on the bottom wall, formed by the lower wall 4*b* and the lower wall of the head cover 5, of the valve chamber 30. Then, the lubricating oil collected on the bottom wall flows through oil passages K7 and K8 (FIG. 2) formed in the cylinder block 2, and an oil pipe 73 connected to the head cover 5 into an oil passage K9 formed in the lower engine case 14, and returns through a return pipe to the oil pan 38.

Figure 5:
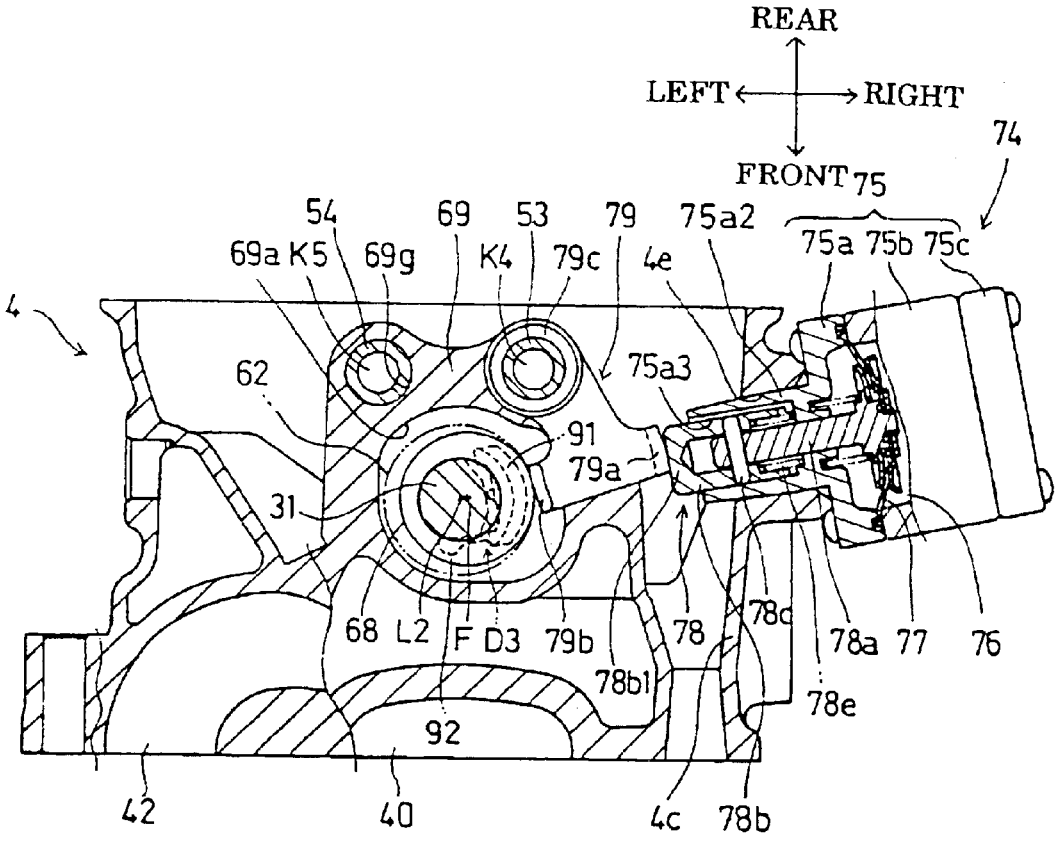
FIG. 5 is a fragmentary sectional view of a cylinder head and a fuel pump generally taken on the line Va—Va in FIG. 3 including a sectional view of a camshaft and a swing arm taken on the line Vb—Vb in FIG. 3.

Referring to FIGS. 2, 3 and 5, a fuel pump 74 for pressurizing the fuel to the carburetor is a displacement pump driven for a pumping action by the pump cam 68. The fuel pump 74 is fastened to a pump mount formed on the outer surface of the right wall 4*c* of the cylinder head 4 with bolts B4.

The pump cam 68 formed in the camshaft 31 is adjacent to the upper side of the second end journal 63 in the bottom part of the valve chamber 30. The decompression mechanism D3 is disposed above and close to the pump cam 68, and the exhaust cam 52 is above the decompression mechanism D3. As shown in FIGS. 5 and 6, the pump cam 68 is a circular eccentric cam of a radius R having its center F displaced by a predetermined eccentricity toward the intake side from the axis L2 of rotation. The circumference of the pump cam 68 serves as a cam surface 68*b*. A section, in which the distance between the axis L2 of rotation and the cam surface 68*b* is greater than the radius R, of the cam surface 68*b* forms a cam lobe Np.

Referring to FIG. 5, the fuel pump 74 has a housing 75 defining a pump chamber 76, a diaphragm 77, and an actuating rod 78 connected to the diaphragm 77.

The housing 75 is formed by stacking up three members 75*a*, 75*b* and 75*c*. The member 75*a* nearest to the cylinder head 4 has a flange 75*a*1 (FIG. 3) fastened to the pump mount with bolts B4, and a tubular projection 75*a*2 projecting through a through hole 4*e* into the valve chamber 30.

The actuating rod 78 is formed by combining a first rod 78*a* connected to the diaphragm 77, and a second rod 78*b* provided with a bottomed hole for receiving the first rod 78*a*, and connected to the first rod 78*a* with a pin 78*c*. The second rod 78*b* is fitted slidably in a guide hole 75*a*3 formed in the tubular projection 75*a*2 so that its end part 78*b*1 projects from the inner open end of the tubular projection 75*a*2 into the valve chamber 30. A swing arm 79, i.e., a pump cam follower, is in contact with the tip of the end part 78*b*1. The actuating rod 78 is pushed by a pushing spring 78*e* toward the valve chamber 30 so that an end part 78*b*1 projects from the tubular projection 75*a*2, and the tip of the end part 78*b*1 is pressed against the swing arm 79.

The tubular projection 75*a*2 and the actuating rod 78 are disposed above the second end journal 63, the pump cam 68, and the lowermost head bolt B1*b* or the lowermost boss S2 provided with a bolt hole for receiving the head bolt B1*b*, or nearer to the exhaust cam 52 with respect to the axial direction A1. The tubular projection 75*a*2 and the actuating rod 78 are spaced a sufficient distance upward from the bottom wall of the valve chamber 30 on which the lubricating oil collects after lubricating the sliding parts of the valve train V and such placed in the valve chamber, and from the lower wall 4*b* toward the exhaust cam 52 in the axial direction A1.

The pump cam 68 drives the swing arm 79 to operate the actuating rod 78 of the fuel pump 74. The swing arm 79 has a fulcrum 79*c* provided with a through hole through which the intake rocker-arm shaft 53 is passed, a contact tip 79*b* in contact with the cam surface 68*b* of the pump cam 68, and a pushing tip 79*a* in contact with the tip of the end part 78*b*1 of the actuating rod 78.

The pump cam 68 that rotates together with the camshaft 31 drives the swing arm 79 to drive the actuating rod 78 for reciprocation. Consequently, the diaphragm 77 is flexed to increase and decrease the volume of the pump chamber 76. The fuel is sucked through a fuel pipe and a suction check valve from the fuel tank into the pump chamber 76 when the volume of the pump chamber 76 is increased. The fuel is forced to flow through the discharge check valve and a fuel pipe from the pump chamber 76 into the carburetor when the volume of the pump chamber 76 is decreased.

The pushing tip 79*a* of the swing arm 79 is in contact with the tip of the end part 78*b*1 of the actuating rod 78 at a position nearer to the decompression mechanism D3 than the contact tip 79*b* with respect to the axial direction A1. More concretely, the pushing tip 79*a* is at a level above those of the pump cam 68 and the contact tip 79*b* and coincides with the axis 14 of swing motion of the decompression mechanism D3 or the shaft support 69 with respect to the axial direction A1. Thus, the swing arm 79 inclines upward from the contact tip 79*b* toward the pushing tip 79*a* with respect to the axial direction A1 and extends over the head bolt B1*b* and the boss S2 formed in the cylinder head 4 so that the swing arm 79 may not interfere with the lowermost head bolt B1*b* coinciding with the pump cam 68 with respect to the axial direction A1 and the boss S2.

The decompression mechanisms D1 to D3 will be described with reference to FIGS. 2, 3, and 6 to 10.

The decompression mechanisms D1 to D3 associated with the cylinders C1 to C3 are identical in construction. As shown in FIG. 6, the decompression mechanisms D1 to D3 are arranged with their decompression cams 92 spaced in the rotating direction A0 of the camshaft 31 at phase differences corresponding to a cam angle of 120°, which corresponds to a crank angle of 240°. Referring to FIGS. 2 and 3, the decompression mechanisms D1 to D3 are disposed on three parts 80, extending downward from the exhaust cams 48, 50 and 52 in contact with the slippers 56*b*, 58*b* and 60*b* of the exhaust rocker arms 56, 58 and 60, of the camshaft 31, respectively.

Description will be made mainly of the decompression mechanism D3 with reference to FIGS. 7 to 10. Reference characters denoting the components of the decompression mechanisms D1 and D2 corresponding to the components of the decompression mechanism D3 mentioned in the following description will be indicated in parentheses.

A first cut part 81 having a flat support surface 81*a* is formed in the part 80 extending downward from the lower end 52*a* of the exhaust cam 52 (48, 50). The support surface 81*a* is included in a plane P1 parallel to the axis L2 of rotation and perpendicular to an axis L4 of swing motion. A second cut part 82 having a flat stopper surface 82*a* is formed so as to extend downward from the lower end of the first cut part 81. The stopper surface 82*a* is included in a plane P2 parallel to the axis L2 of rotation and perpendicular to the plane P1.

Figure 7A:
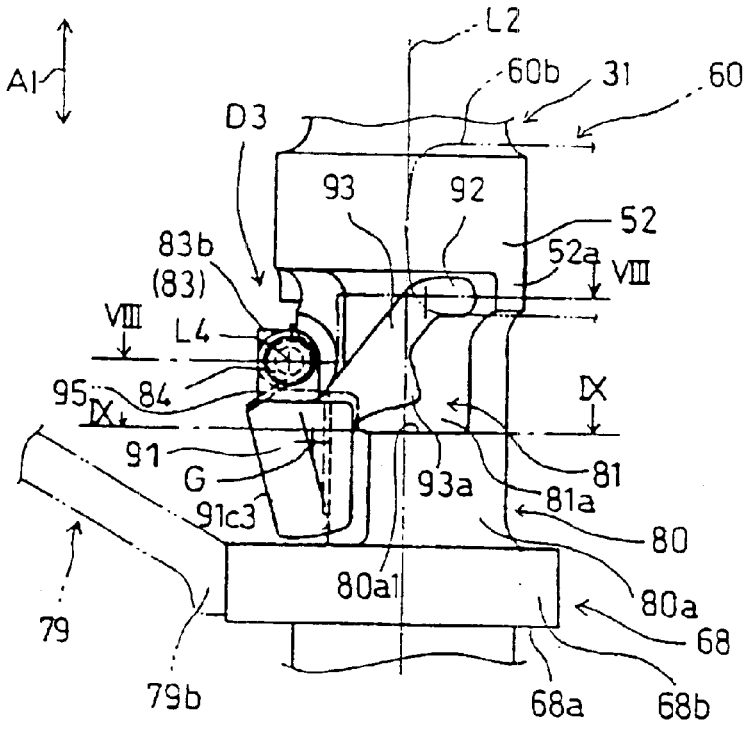
FIG. 7A is a fragmentary side elevation taken in the direction of the arrow VII in FIG. 6, in which the decompression mechanism is in an operative state.
Figure 8:
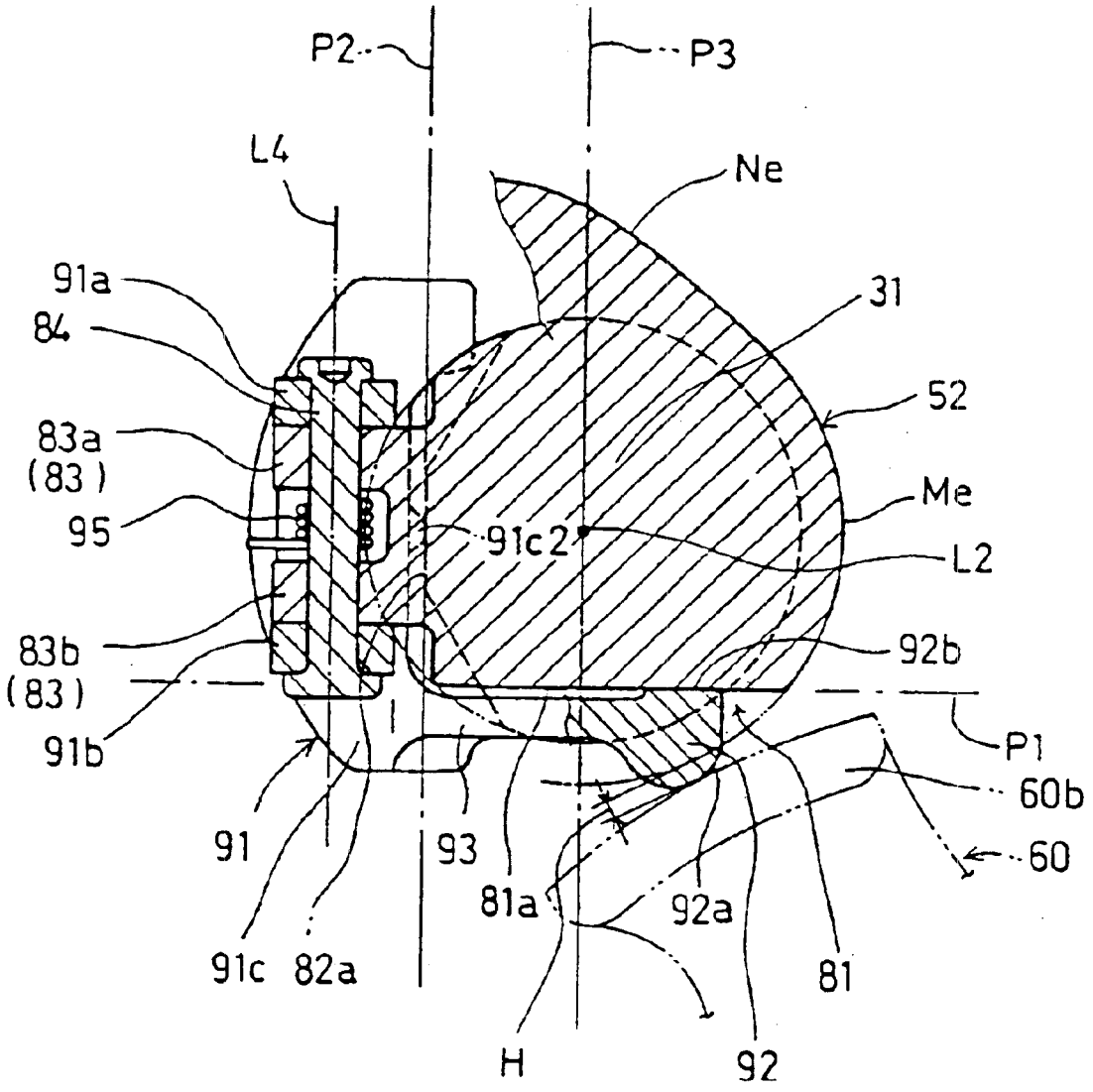
FIG. 8 is a cross-sectional view taken on the line VIII—VIII in FIG. 7A.
Figure 9:
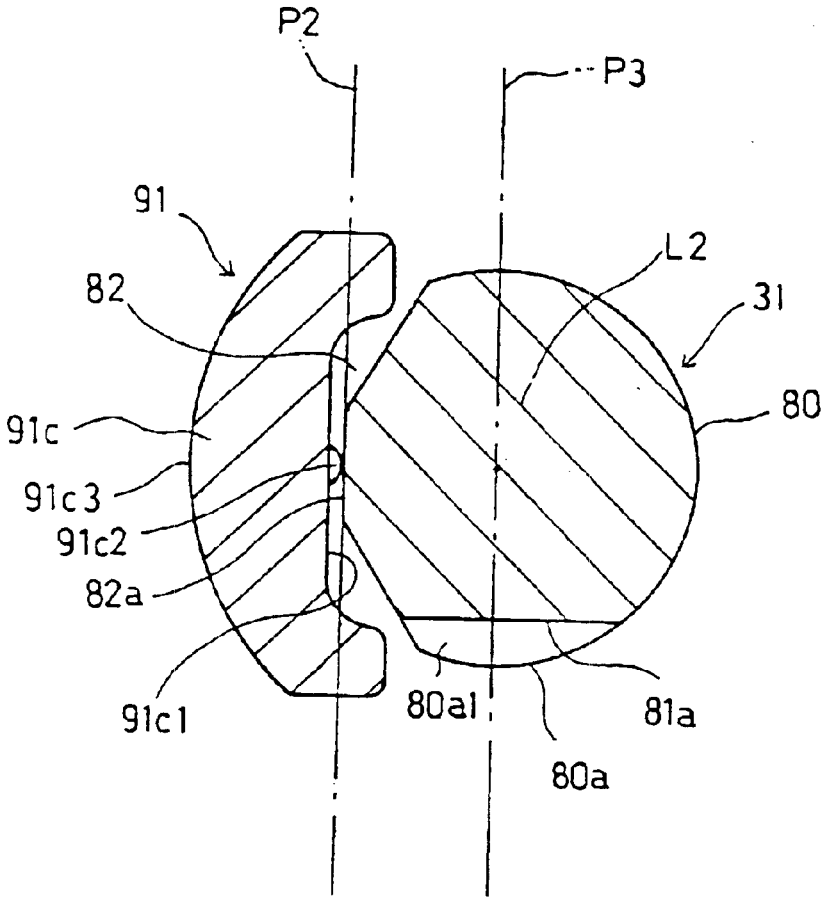
FIG. 9 is a cross-sectional view taken on the line IX—IX in FIG. 7A.

As shown in FIGS. 7A and 8, a support part 83 having a pair of projections 83*a* and 83*b* is formed integrally with the part 80 of the camshaft 31 above the second cut part 82. The pair of projections 83*a* and 83*b* project radially outward in parallel to the plane P1. A cylindrical pin 84 for supporting a centrifugal weight 91 for swing motion on the camshaft 31 is fitted in holes formed in the projections 83*a* and 83*b*.

Referring to FIGS. 10A to 10D, the decompression mechanism D3 includes a decompression member 90 of a metal formed by injection molding, and a return spring 95, i.e., a torsion coil spring. The decompression member 90 has the centrifugal weight 91 supported for swing motion on the support part 83 by the pin 84, a decompression cam 92 that turns together with the centrifugal weight 91 and comes into contact with the slipper 60*b* (56*b*, 58*b*) to open the exhaust valve 44 at the start of the internal combustion engine E, and a plate-shaped arm 93 connecting the centrifugal weight 91 and the decompression cam 92.

The return spring 95 is disposed between the pair of projections 83*a* and 83*b*. The return spring 95 has a resilience capable of applying the moment of a force high enough to hold the centrifugal weight 91 at its operative position shown in FIG. 7A until the engine speed increases to a predetermined engine speed at the start of the internal combustion engine E.

The centrifugal weight 91 has a weight body 91*c*, and a pair of knuckles 91*a* and 91*b* projecting from the weight, body 91*c*. The knuckles 91*a* and 91*b* are adjacent to the upper side of the projection 83*a* and the lower side of the projection 83*b*, respectively, with respect to a direction parallel to the axis L4 of swing motion. The pin 84 is fitted in holes formed in the knuckles 91*a* and 91*b* so that the knuckles 91*a* and 91*b* are able to turn on the pin 84.

Figure 10A:
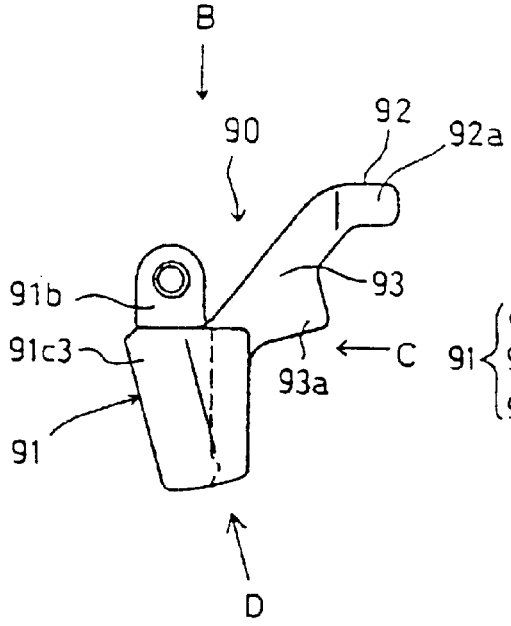
FIG. 10A is a side elevation of a decompressing member included in the decompression mechanism.
Figure 10B:
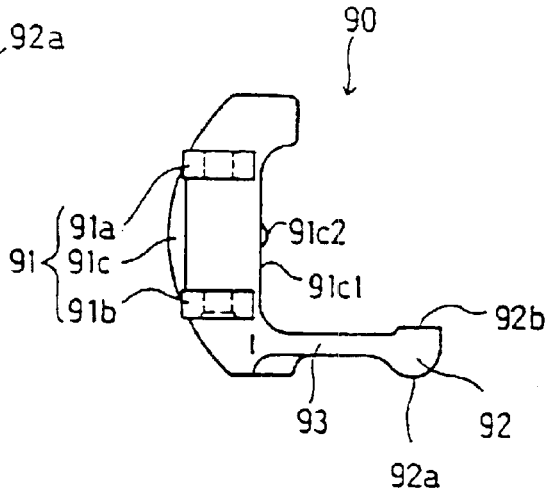
FIG. 10B is a view taken in the direction of the arrow B in FIG. 10A.
Figure 10C:
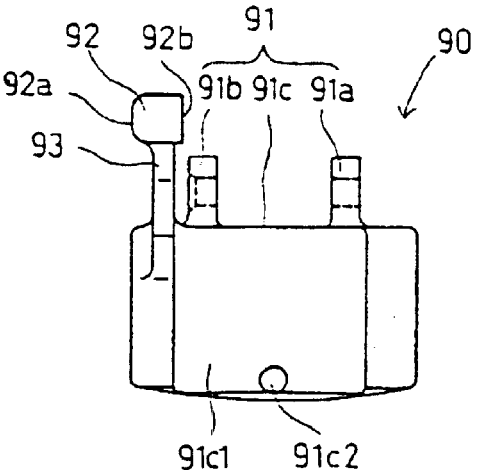
FIG. 10C is a view taken in the direction of the arrow C in FIG. 10A.
Figure 10D:
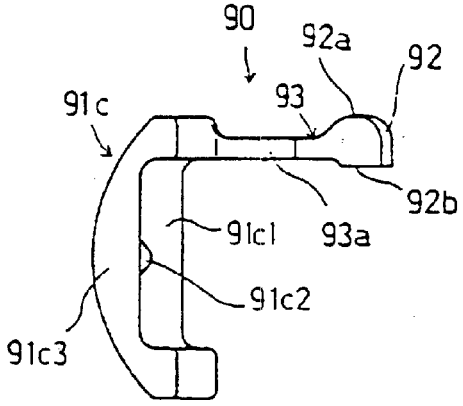
FIG. 10D is a view taken in the direction of the arrow D in FIG. 10A.

The weight body 91*c* has a flat surface 91*c*1 facing the camshaft 31 and provided with a contact protrusion 91*c*2. The weight body 91*c* has an outer surface 91*c*3 facing radially outward. As best shown in FIG. 10D, the outer surface 91*c*3 has a shape substantially resembling the shape of a part of the surface of a circular cylinder. The contact protrusion 91*c*2 rests on the stopper surface 82*a* of the second cut part 82 to set the centrifugal weight 91 (or the decompression member 90) at an operative position. The arm 93 has a lower surface provided with a contact protrusion 93*a*. The contact protrusion 93*a* rests on a stopper surface formed in a step 80*a* to set the centrifugal weight 91 (or the decompression member 90) at the radially outermost position to make the decompression mechanism D3 inoperative.

The decompression cam 92 formed at the free end of the arm 93 has a cam surface protruding from one side of the arm 93 in a direction parallel to the axis L4 of swing motion, and a contact surface 92*b* on the other side of the arm 93 in contact with the support surface 81*a*. The contact surface 92*b* slides along the support surface 81*a* when the centrifugal weight 91 turns on the pin 84. The decompression cam 92 projects from the round base part Me of the exhaust cam 52 (48, 50) in a predetermined height H (FIG. 8) when the decompression member 90 is at the operative position. A decompression lift by which the exhaust valve 44 is lifted for decompression is dependent on the height H.

Figure 7B:
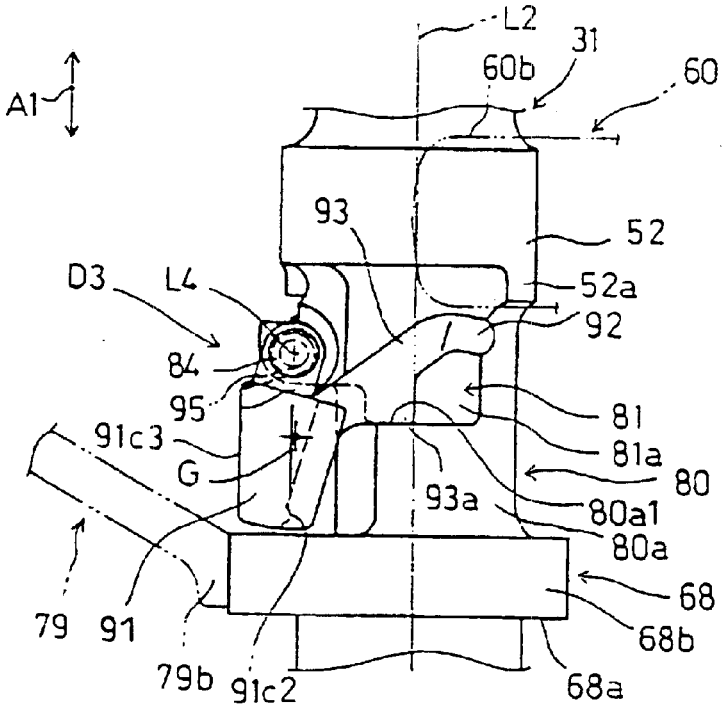
FIG. 7B is a fragmentary side elevation taken in the direction of the arrow VII in FIG. 6, in which the decompression mechanism is in an inoperative state.

The operation of the decompression mechanism D3 (D1, D2) will be described. Referring to FIGS. 7A and 7B, the center G of gravity of the decompression member 90 is nearer to a plane P3 including the axis L2 of rotation and parallel to the plane P2 than the axis L4 of swing motion while the internal combustion E is stopped and the camshaft 31 is not rotating. In this state, the weight of the decompression member 90 produces a clockwise moment of force about the axis L4 of swing motion. However, counterclockwise moment of force produced by the resilience of the return spring 95 exceeds the clockwise moment of force and holds the contact protrusion 91*c*2 (FIG. 9) of the centrifugal weight 91 in contact with the stopper surface 82*a* to keep the decompression member 90 at the operative position.

The starter knob 13*a* (FIG. 1) connected to a rope wound around a reel included in the recoil starter 13 is pulled to start the internal combustion engine E and thereby the crankshaft 9 is rotated. Since the engine speed is not higher than the predetermined engine speed at this stage, the decompression member 90 remains at the operative position. Consequently, the decompression cam 92 projecting radially outward from the round base part Me of the exhaust cam 52 (43, 50) comes into contact with the slipper 60*b* (56*b*, 58*b*) of the exhaust rocker arm 60 (56, 58) to lift up the exhaust valve 44 by the decompression lift while the piston 7 in the cylinder C3 (C1, C2)is in the compression stroke. Thus, the air-fuel mixture compressed in the cylinder C3 (C1, C2) is discharged through the exhaust port 42 to reduce the compression pressure in the cylinder C3 (C1, C2). Consequently, the piston 7 is able to move easily past the top dead center and hence operating force necessary for operating the recoil starter 13 is reduced.

After the engine speed increases beyond the predetermined engine speed, the moment of force produced by centrifugal force acting on the decompression member 90 exceeds the moment of force produced by the resilience of the return spring 95. When the slipper 60*b* (56*b*, 58*b*) is not in contact with the decompression cam 92, the decompression member 90 starts being turned radially outward by the moment of force produced by the centrifugal force, and the arm 93 slides along the support surface 81*a*. The decompression member 90 is thus turned until the contact protrusion 93*a* of the arm 93 comes into contact with the stopper surface 80*a*1 and, finally, the decompression member 90 is held at the inoperative position as shown in FIG. 7B.

When the decompression member 90 is held at the inoperative position, the decompression cam 92 is moved from a position on the first cut part 81 coinciding with the exhaust cam 52 (48, 50) with respect to the axial direction A1 in the axial direction A1 and is separated from the slipper 60*b* (56*b*, 58*b*). Consequently, the decompression mechanism D3 (D1, D2) becomes inoperative, and the slipper 60*b* (56*b*, 58*b*) is in contact with the round base part Me of the exhaust cam 52 (48, 50) to keep the exhaust valve 44 closed while the piston 7 in the cylinder C3 (C1, C2) is in the compression stroke, so that the air-fuel mixture is compressed at a normal compression pressure. Then, the engine speed increases gradually and the operating mode of the internal combustion engine E changes through a perfect-combustion mode to an idling mode.

Referring to FIGS. 2 and 3, the axes L4 of swing motion of the decompression mechanisms D1 and D3 for the first cylinder C1 and the third cylinder C3 are below the exhaust rocker arms 56 and 60, respectively, with respect to the axial direction A1, and the decompression mechanisms D1 and D3 are below the lower ends of the exhaust cams 48 and 52, respectively, with respect to the axial direction. On the other hand, the axis L4 of swing motion of the decompression mechanism D2 for the second cylinder C2 is in an axial range between the positions with respect to the axial direction A1 of the slipper 58*b* and the adjusting screw 58*a* of the exhaust rocker arm 58. The end 44A of the exhaust valve 44 coincides with the centrifugal weight 91 of the decompression mechanism D2 with respect to the axial direction A1, and most part of the decompression mechanism D2, i.e., a part between the decompression cam 92 and a more than half part of the centrifugal weight 91, coincides with the exhaust rocker arm 58 with respect to the axial direction A1.

The pin 84, part of the arm 93 and part of the centrifugal weight 91 of the decompression 117 mechanism D3 associated with the third cylinder C3 are received in the through hole 69*a* of the shaft support 69 and coincide with the shaft support 69 with respect to the axial direction A1. As shown in FIGS. 2 and 3, the decompression mechanism D3 is opposite the second end bearing 66 and the second end journal 63 with respect to the pump cam 68 and the axial direction A1, and is adjacent to the upper end of the pump cam 68.

Referring to FIGS. 5 and 6, the decompression mechanism D3 is mounted on the camshaft 31 such that the axis L4 of swing motion of the centrifugal weight 91 is perpendicular to a reference line L5 connecting the axis L2 of rotation and the tip Np1 of the cam lobe Np as viewed along the axial direction A1, and the centrifugal weight 91 is substantially symmetrical with respect to the reference line L5. The centrifugal weight 91 including the center G of gravity is disposed on the cam lobe side of the pump cam 68, i.e., on the side of the center F of the pump cam 68 with respect to the axis L2 of rotation as viewed from the axial direction A1. The term "cam lobe side" signifies one side on which the cam lobe N0 or the tip Np1 lies with respect to a plane including the axis L2 of rotation and perpendicular to the reference line L5.

When the centrifugal weight 91 turns from the operative position toward the inoperative position as the rotating speed of the camshaft 31 increases, the centrifugal weight 91 turns toward the tip Np1 of the cam lobe Np relative to the axis L2 of rotation of the camshaft 31 as viewed from the axial direction A1. More concretely, the centrifugal weight 91 turns toward the tip Np1 of the cam lobe Np along the reference line L5.

As shown in FIGS. 6, 7A and 7B, the outermost position, with respect to a direction along the diameter of the camshaft 31, of the outer surface 91*c*3 of the centrifuigal weight 91 of the decompression mechanism D3 when the centrifugal weight 91 is at the inoperative position coincides substantially with that of the outermost part of the centrifugal weight 91 at the operative position. Therefore, the decompression mechanism D3 including the centrifugal weight 91, in either an operative state or an inoperative state, is contained entirely in a projection of the pump cam 68 on a plane perpendicular to the axial direction A1; that is, the centrifugal weight 91 swings in a range corresponding to the cam surface 68*b* of the pump cam 68 or in a range overlapping the pump cam 68. The centrifugal weight 91 swings inside a range in which the cam lobe N0 is formed at least on the cam lobe side.

The operation and effect of the embodiment will be described.

The pump cam 68 for driving the fuel pump 74 abuts on the second end bearing 66 supporting the second end journal 63 of the camshaft 31 and serves as a thrust bearing member for restraining the camshaft 31 from downward movement. The decompression mechanism D3 associated with the third cylinder C3, i.e., the bottom cylinder, is disposed opposite the second end bearing 66 with respect to the axial direction A1 relative to the pump cam 68 and is adjacent to the upper side of the pump cam 68. Since the pump cam 68 servers also as a thrust bearing member, an additional space in the axial direction A1 along the camshaft 31, which is not available when both a pump cam and a thrust bearing member are formed on the camshaft 31, is available, and the decompression mechanism D3 can be disposed near the pump cam 68 with respect to the axial direction A1. Thus, increase in the length of the camshaft 31 provided with the pump cam 68 and the decompression mechanism D3 and in the axial dimension of the valve chamber 30 can be suppressed, and the internal combustion engine E can be formed in compact construction.

The pump cam 68 for driving the fuel pump 74 is in contact with the second end bearing 66 among the three bearings 64, 65 and 66 supporting the three journals 61, 62 and 63 of the camshaft, 31 and serves as a thrust bearing member that restrains the camshaft 31 from downward movement. Further, the pump cam 68, the intake cam 51, the exhaust cam 52 and the decompression mechanism D3 associated with the third cylinder C3 are arranged between the second end bearing 66 and the middle bearing 65, and the exhaust cam 52 is adjacent to the pump cam 68 on the upper side of the second end bearing 66. Thus, a space in the axial direction A1 along the camshaft 31, which is not available when a pump cam and a thrust bearing member are formed separately between the second end bearing 66 and the middle bearing 65 respectively on the opposite sides of the third cylinder C3, is available, and the intake cam 51, the exhaust cam 52 and the decompression mechanism D3 can be disposed near the pump cam 68. Thus, increase in the length of the camshaft 31 provided with the pump cam 68 and the decompression mechanism D3 and in the axial dimension of the valve chamber 30 can be suppressed, and the internal combustion engine E can be formed in compact construction.

The connecting member 36 connecting the camshaft 31, and the shaft 37*a* of the oil pump 37 coincides with the second end journal 63 and the second end bearing 66 with respect to the axial direction A1, which also suppresses increase in the length of the camshaft 31.

The centrifugal weight 91, supported for turning on the camshaft 31 adjacently to the pump cam 68 with respect to the axial direction A1, of the decompression mechanism D3 is on the same side as the cam lobe of the pump cam 68 as viewed from the axial direction A1, and turns toward the tip Np1 of the cam lobe Np relative to the axis L2 for rotation along the reference line LS. Thus, the centrifugal weight 91 is disposed on the cam lobe side toward the tip Np1 farthest from the axis L2 of rotation. Therefore, the range of swing motion in which the centrifugal weight 91 turns until the same overlaps the cam surface 68*b* of the pump cam 68 as viewed from the axial direction A1 is larger than a swing range in which a centrifugal weight disposed outside the cam lobe side turns radially outward. Thus, decompression mechanism D3 can be disposed near the pump cam 68, avoiding interference between the centrifugal weight 91 and the swing arm 79 in the range of swing motion of the centrifugal weight 91. Consequently, increase in the length of the camshaft 31 and in the axial dimension of the valve chamber 30 can be suppressed, and the internal combustion engine E can be formed in compact construction.

Since the centrifugal weight 91, disposed near the pump cam 68 with respect to the axial direction A1, and supported on the camshaft 31 so as to be radially movable, of the decompression mechanism D3 moves inside a range defined by the cam surface 68*b* of the pump cam 68 as viewed from the axial direction A1, the centrifugal weight 91 does not project outward from the cam surface 68*b*. Thus, the decompression mechanism D3 can be disposed near the pump cam 68, avoiding interference between the centrifugal weight 91 and the swing arm 79 in the range of swing motion of the centrifugal weight 91. Consequently, increase in the length of the camshaft 31 and in the axial dimension of the valve chamber 30 can be suppressed, and the internal combustion engine E can be formed in compact construction.

Since the centrifugal weight 91 swings within a range corresponding to the cam lobe Np and defined by the angular range of the cam lobe Np, increase in the radial dimension of the pump cam 68 can be avoided.

The decompression mechanism D3 is disposed near the second end journal 63 between the pump cam 68 for driving the actuating rod 78 of the fuel pump through the swing arm 79, and the exhaust cam 52 for opening and closing the exhaust valve 44 interlocked with the decompression mechanism D3, and the swing arm 79 has the contact tip 79*b* in contact with the cam surface 68*b* of the pump cam 68, and the pushing tip 79*a* in contact with the tip of the end part 78*b*l of the actuating rod 78. Therefore, the actuating rod 78 and the tubular projection 75*a*2, projecting into the valve chamber 30, of the fuel pump 74 can be disposed apart from the lower wall 4*b* of the cylinder head 4 with respect to the axial direction A1, and can be prevented from interference with the head bolt B1*b* and the boss S2 at positions coinciding with the pump cam 68 with respect to the axial direction A1. Thus, increase in the length of the camshaft 31, and the projection in the axial direction A1 of the fuel pump 74 from the cylinder head 4 can be suppressed and the internal combustion engine E can be formed in compact construction.

The valve train V includes the camshaft 31 provided with the intake cams 47, 49 and 51 for driving the intake rocker arms 55, 57 and 59 to open and close the intake valves 43, and the exhaust cams 48, 50 and 52 for driving the exhaust rocker arms 56, 58 and 60 to open and close the exhaust valves 44 for the cylinders C1 to C3. The exhaust cam 50 for opening and closing the exhaust valve 44 operated for opening and closing by the decompression mechanism D2 for the second cylinder C2, i.e., the middle cylinder at the middle of the cylinder row, does not coincide with the end 44A of the valve stem of the exhaust rocker arm 58 in contact with the tip 58*a*1 of the adjusting screw 58*a* with respect to the axial direction A1. The decompression mechanism D2 coincides with the end 44A of the valve stem of the exhaust valve 44 with respect to the axial direction A1. The axis L4 of swing motion of the decompression mechanism D2 lies in the axial range between the slipper 58*b* of the exhaust rocker arm 58, and the adjusting screw 58*a*, the end 44A of the valve stem of the exhaust valve 44 coincides with the centrifugal weight 91 of the decompression mechanism D2 with respect to the axial direction A1, and most part of the decompression mechanism D2, i.e., part between the decompression cam 92 and more than half part of the centrifugal weight 91, coincides with the exhaust rocker arm 58 with respect to the axial direction A1. Therefore, the exhaust cam 50 can be offset from the end 44A of the valve stem of the exhaust valve 44 to a position not coinciding with the end 44A of the valve stem of the exhaust cam 44 with respect to the axial direction, and the decompression mechanism D2 is disposed so as to coincide with the end 44A of the valve stem of the exhaust valve 44 with respect to the axial direction A1 by using an axial space provided by offsetting the exhaust cam 50. Thus, a sufficient space is available for disposing the decompression mechanism D2, increase in the length of the camshaft 31 extending across the three cylinders C1, C2 and C3, and increase in the axial dimension of the valve chamber 30 in the axial direction A1 can be suppressed, and the internal combustion engine can be formed in compact construction.

The exhaust cam 50 for the second cylinder C2 is offset toward the first cylinder C1 relative to the end 44A of the valve stem of the exhaust valve 44. The cylindrical part 31*c* of the camshaft 31 extends between the intake cam 49 for the second cylinder C2 and the decompression mechanism D1 for the first cylinder D1, and is not provided with any journal to be supported by a bearing. Thus, the axial space in the axial direction A1 is available in the cylindrical part 31*c*. This space enables offsetting the exhaust cam 50 relative to the end 44A of the valve stem of the exhaust valve 44. Thus, increase in the length of the camshaft 31 and in the axial dimension of the valve chamber 30 can be suppressed and the internal combustion engine E can be formed in compact construction.

The intake cam 49 formed on the camshaft 31 for the second cylinder C2 is adjacent to the decompression mechanism D1 for the first cylinder C1, and any journals and such that prevent forming the intake cams 47 and 49, the exhaust cams 48 and 50 or the decompression mechanisms D1 and D2 associated with the cylinders C1 and C2 from being adjacently formed are not formed on the camshaft 31. Therefore,a sufficient space is available for disposing the decompression mechanisms D1 and D2. Thus, increase in the length of the camshaft 31 and in the axial dimension of the valve chamber 30 can be suppressed and the internal combustion engine E can be formed in compact construction.

A cylindrical part 31*d* of the camshaft 31 extends between the decompression mechanism D2 associated with the second cylinder C2, and the intake cam 51 for the third cylinder C3, and the middle bearing 65 is formed at the position corresponding to the cylindrical part 31*d*. Consequently, the deformation of the camshaft 31 due to loads on the intake cams 47, 49 and 51, and those on the exhaust cams 48, 50 and 52 can effectively prevented, and hence the stable operation of the valve train V can be ensured while the internal combustion engine E is operating at high engine speeds.

Modifications of the foregoing embodiment will be described.

The middle bearing 65,may be disposed between the first cylinder C1 and the second cylinder C2 instead of between the second cylinder C2 and the third cylinder C3. If the middle bearing 65 is disposed so, the intake cam 49, the exhaust cam 50 and the decompression mechanism associated with the second cylinder C2 are formed in the same shapes and arranged in the same arrangement as those associated with the first cylinder C1, the third cylinder C3 is a specific cylinder, and the intake rocker arm 59 and the exhaust rocker arm 60 for the third cylinder C3 are specific rocker arms, and the intake cam 51, the exhaust cam 52 and the decompression mechanism D3 are formed in the same shapes and arranged in the same arrangement as the intake cam 49, the exhaust cam 50 and the decompression mechanism D2 for the second cylinder C2 in the foregoing embodiment.

The decompression mechanisms D1 to D3 may open the intake valves 43 instead of the exhaust valves 44. If the decompression mechanisms D1 to D3 operate so, the intake cams are specific cams.

If the decompression mechanism D3 opens the intake valve 43 for the third cylinder C3, the decompression mechanism D3 may be disposed adjacently to the intake cam 51 below the intake cam 51, the exhaust rocker arm 60 may be formed in the specific rocker arm, the exhaust cam 52 may be disposed adjacently to and above the pump cam 68, the decompression mechanism D3 may be disposed above the exhaust cam 52, and the intake cam 51 may be formed above the decompression mechanism D3 between the intermediate bearing 65 and the second end bearing 66.

Depending on the arrangement of the intake cam 51 and the exhaust cam 52 for the third cylinder C3 dependent on the arrangement of the intake valve 43 and the exhaust valve 44, the intake valve 43 or the exhaust valve 44 may be disposed opposite the second end bearing 66 with respect to the axial direction A1 relative to the pump cam 68 and adjacently to the pump cam 68 when the intake valve 43 is opened by the decompression mechanism D3 disposed below the intake cam 51.

Although the centrifugal weight 91 is pivotally supported on the camshaft 31 so as to turn radially outward in the foregoing embodiment, the centrifugal weight 91 may be supported for sliding.

The fuel pump 74 may be attached to the head cover 5, i.e., a valve chamber forming member combined with the cylinder head 4 to form the valve chamber 30. The specific bearing may be the first end bearing 64 or the middle bearing 65 instead of the second end bearing 66.

The internal combustion engine may be a single-cylinder internal combustion engine or a multi-cylinder internal combustion engine other than a three-cylinder internal combustion engine. The internal combustion engine is not limited to a vertical internal combustion engine and may be an internal combustion engine for conveyances including vehicles other than the outboard engine, and stationary machines.

Although there have been described what are the present embodiments of the invention, it will be understood that variations and modifications may be made thereto without departing from the spirit or essence invention.

What is claimed is:

1. An internal combustion engine comprising:

a camshaft interlocked with a crankshaft;

a valve chamber forming member forming a valve chamber for containing the camshaft;

a valve train arranged in the valve chamber to open and close intake and exhaust valves;

decompression mechanisms arranged in the valve chamber to open the intake or the exhaust valves during a compression stroke;

a fuel pump having an actuating member extending in the valve chamber, and attached to the valve chamber forming member;

a plurality of bearings arranged in the valve chamber to support the camshaft;

journals formed in the camshaft and supported by the bearings, the number of the journals being equal to that of the bearings; and a pump cam for driving the actuating member through a cam follower, formed on the cam shaft adjacently to an end one of said journals at one axial end of the camshaft with respect to an axial direction of the camshaft;

wherein a specific one among the decompression mechanisms is provided opposite the end one of said journals relative to the pump cam with respect to the axial direction, the camshaft is provided with valve cams for opening and closing the intake and the exhaust valves for a cylinder associated with the specific decompression mechanism, the specific decompression mechanism is disposed between the pump cam and the valve cams, and the cam follower has a contact tip in contact with the pump cam, and a pushing tip in contact with the actuating member at a position nearer to the valve cams than the contact tip with respect to the axial direction.

2. The internal combustion engine according to claim 1, wherein the cam follower is a swing arm.

3. An internal combustion engine comprising:

a camshaft interlocked with a crankshaft;

a valve chamber forming member forming a valve chamber for containing the camshaft;

a valve train arranged in the valve chamber to open and close intake and exhaust valves;

decompression mechanisms arranged in the valve chamber to open the intake or the exhaust valves during a compression stroke;

a plurality of bearings arranged in the valve chamber to support the camshaft;

journals formed in the cam shaft and supported by the bearings, the number of the journals being equal to that of the bearings;

a fuel pump drive cam formed on the camshaft so as to be in contact with a specific one of the plurality of bearings to serve as a thrust bearing member restraining the camshaft from axial movement; and a specific one of the decompression mechanisms being provided opposite the specific bearing relative to the fuel pump drive cam with respect to an axial direction of the camshaft and adjacent to the fuel pump drive cam.

4. An internal combustion engine comprising:

a camshaft interlocked with a crankshaft;

a valve chamber forming member forming a valve chamber for containing the camshaft;

a valve train arranged in the valve chamber to open and close intake and exhaust valves;

decompression mechanisms arranged in the valve chamber to open the intake or the exhaust valves during a compression stroke;

a fuel pump having an actuating member extending in the valve chamber, and attached to the valve chamber forming member;

a plurality of bearings arranged in the valve chamber to support the camshaft;

journals formed in the camshaft and supported by the bearings, the number of the journals being equal to that of the bearings; and a fuel pump drive cam formed on the camshaft so as to be in contact with a specific one of the plurality of bearings to serve as a thrust bearing member restraining the camshaft from axial movement;

wherein the fuel pump drive cam, valve cams for one cylinder of cylinders included in the internal combustion engine, and a specific one of said decompression mechanisms are arranged between the specific bearing and the bearing axially adjacent to the specific bearing, and the valve cams or the specific decompression mechanism are disposed opposite the specific bearing relative to the fuel pump drive cam with respect to an axial direction parallel to the camshaft, and adjacently to the fuel pump drive cam.

5. The internal combustion engine according to claim 1, wherein the pushing tip is at a level above those of the pump cam and the contact tip and coincides with an axis of swing motion of the specific decompression mechanism.

6. The internal combustion engine according to claim 1, wherein the cam follower inclines upward from the contact tip toward the pushing tip with respect to the axial direction.

7. The internal combustion engine according to claim 1, wherein:

the pump cam contacts with a specific one of the plurality of bearings to serve as a thrust bearing member restraining the camshaft from axial movement; and the specific decompression mechanism is provided opposite the specific bearing relative to the pump drive cam with respect to the axial direction and adjacent to the pump cam.

8. The internal combustion engine according to claim 1, wherein:

the pump cam contacts with a specific one of the plurality of bearings to serve as a thrust bearing member restraining the camshaft from axial movement;

the pump cam, the valve cams for one cylinder of cylinders included in the internal combustion engine, and the specific decompression mechanism is arranged between the specific bearing and the bearing axially adjacent to the specific bearing, and the valve cams or the specific decompression mechanism are disposed opposite the specific bearing to the pump cam with respect to the axial direction, and adjacently to the pump cam.

* * * * *

UNITED STATES PATENT AND TRADEMARK OFFICE

CERTIFICATE OF CORRECTION

PATENT NO. : 6,796,294 B2
DATED : September 28, 2004
INVENTOR(S) : Masanori Tsubouchi It is certified that error appears in the above-identified patent and that said Letters Patent is hereby corrected as shown below:

Title page,
Item [57], ABSTRACT,
Line 11, between "the pump" and "cam and a pushing tip", delete the comma; after "the pump cam" and before "a pushing tip", insert a comma.

Column 1,
Line 49, after "groove of the thrust holder." begin a new paragraph, starting with "When the fuel".

Column 8,
Line 65, between "mechanisms D1 and D3" and "the exhaust", change "opens and Closes" to -- open and close --.

Column 10,
Line 11, between "of the middle" and "62, a through hole", change "Journal" to -- journal --.

Column 11,
Line 19, between "the end of" and "of the valve" change "43A" to -- 43a --.

Column 12,
Line 4, at the end of the line change "d3," to -- D3, --.

Column 17,
Line 6, between "of the camshaft" and "31 and serves", delete the comma;
Line 37, between "the reference line" and "Thus, the centrifugal" change "LS" to -- L5 --.

Column 18,
Line 50, between "stem of the exhaust" and "44" change "cam" to -- valve --.

UNITED STATES PATENT AND TRADEMARK OFFICE

CERTIFICATE OF CORRECTION

PATENT NO. : 6,796,294 B2
DATED : September 28, 2004
INVENTOR(S) : Masanori Tsubouchi It is certified that error appears in the above-identified patent and that said Letters Patent is hereby corrected as shown below:

Column 20,
Between lines 28 and 29, between “spirit or essence” and “invention.”, insert -- of the --.

Signed and Sealed this

Twenty-second Day of February, 2005

JON W. DUDAS
*Director of the United States Patent and Trademark Office*